US008378298B2

(12) United States Patent
Collings et al.

(10) Patent No.: US 8,378,298 B2
(45) Date of Patent: Feb. 19, 2013

(54) HIGH RESOLUTION EXCITATION/ISOLATION OF IONS IN A LOW PRESSURE LINEAR ION TRAP

(75) Inventors: Bruce A. Collings, Bradford (CA); Yves J. C. Leblanc, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 13/251,554

(22) Filed: Oct. 3, 2011

(65) Prior Publication Data

US 2012/0112054 A1 May 10, 2012

Related U.S. Application Data

(63) Continuation of application No. 12/240,060, filed on Sep. 29, 2008, now Pat. No. 8,030,612.

(60) Provisional application No. 60/986,687, filed on Nov. 9, 2007.

(51) Int. Cl.
*H01J 49/42* (2006.01)

(52) U.S. Cl. ..... 250/290; 250/292; 250/288; 250/282

(58) Field of Classification Search ..... 250/290, 250/292, 288, 282
See application file for complete search history.

(56) References Cited

U.S. PATENT DOCUMENTS

| | | | | |
|---|---|---|---|---|
| 6,949,743 | B1 | 9/2005 | Schwartz | |
| 7,045,777 | B2 * | 5/2006 | Cotter | 250/281 |
| 7,049,580 | B2 | 5/2006 | Londry et al. | |
| 7,285,773 | B2 * | 10/2007 | Ding et al. | 250/282 |
| 7,888,634 | B2 | 2/2011 | Guna et al. | |
| 8,030,612 | B2 | 10/2011 | Collings et al. | |
| 2004/0065824 | A1 | 4/2004 | Bateman et al. | |
| 2008/0135747 | A1 | 6/2008 | Brekenfeld | |
| 2009/0194683 | A1 | 8/2009 | Guna et al. | |
| 2009/0194684 | A1 | 8/2009 | Guna et al. | |
| 2009/0194686 | A1 | 8/2009 | Guna et al. | |

FOREIGN PATENT DOCUMENTS

| | | |
|---|---|---|
| WO | 0024037 A1 | 4/2000 |
| WO | 0033350 A2 | 6/2000 |

OTHER PUBLICATIONS

Collings, B.A. et al.; "Resonant excitation in a low pressure linear ion trap", J. Am. Soc. Mass Spectrom, vol. 14, pp. 622-634, Fig. 1 (May 2, 2003).

Collings, B.A.; "Increased fragmentation efficiency of ions in a low pressure linear ion trap with an added de octopole field", J. Am Soc. Mass Spectrom, vol. 16, pp. 1342-1352, Fig. 1 (Jun. 24, 2005).

* cited by examiner

*Primary Examiner* — Nikita Wells
*Assistant Examiner* — Johnnie Smith

(57) ABSTRACT

Methods for improved separation of ions from an ion trap employing a combination of low pressure and low amplitude ion excitation, including methods for removing, from an ion trap ion population, ions having a m/z value neighboring that of an ion of interest, mass spectrometry methods providing improved resolution of ion detection, and programmable apparatus programmed with instructions therefor.

49 Claims, 11 Drawing Sheets

Figure 1:
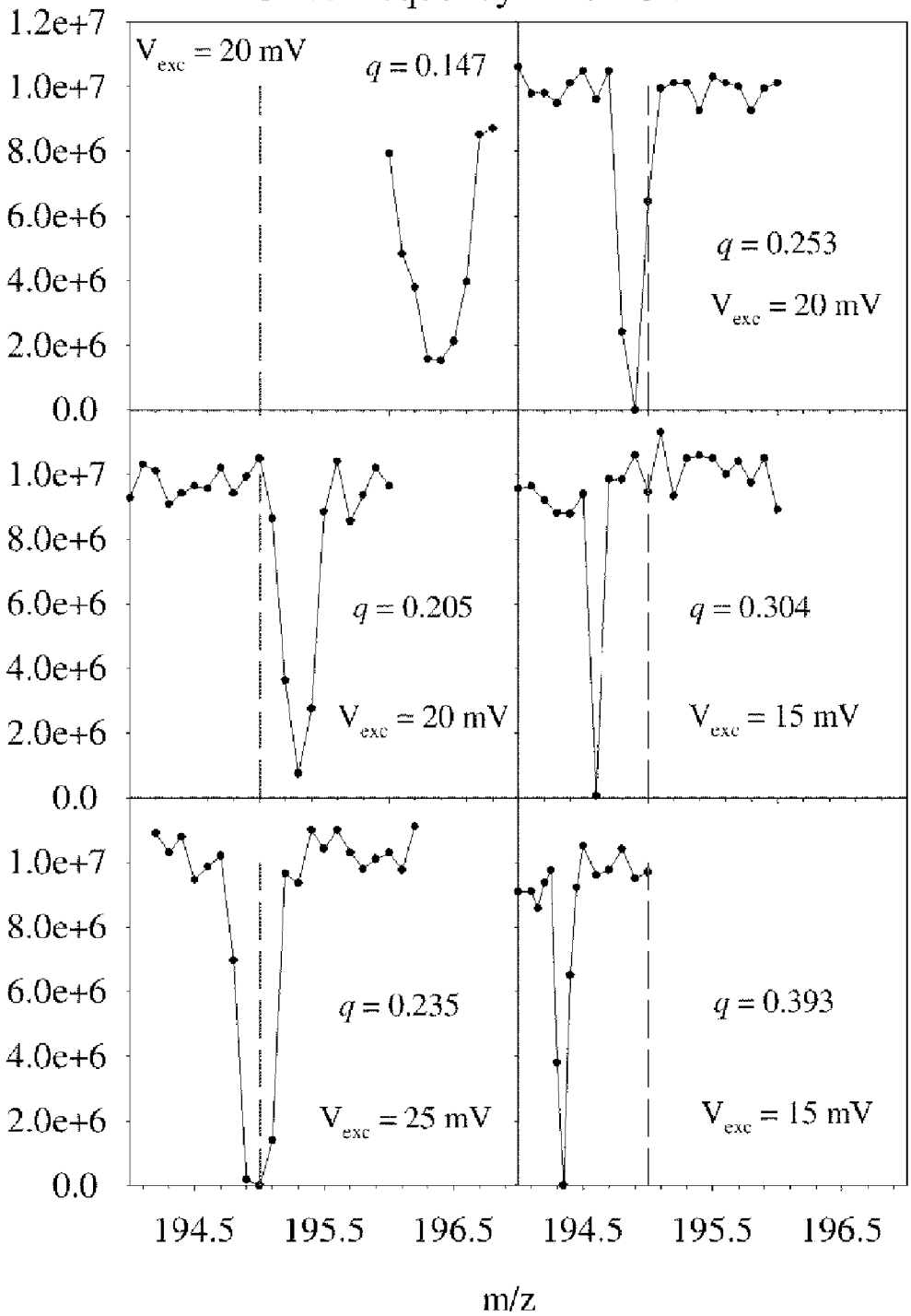

Resonance profiles of 195 m/z as a function of $q$
The profile at $q = 0.235$ was used as a reference,
drive frequency is 1.228 MHz Resonance excitation profile of caffiene (195 m/z).
$t_{exc}$ = 100 ms, $V_{exc}$ = 7.5 $mV_{0\text{-}p}$, $q$ = 0.705846.

Fendiline (316.206 m/z) and Chlorprothixene (316.0921 m/z) mixture with Δm/z = 0.1139.

Oxycodone (316.1543 m/z) and Chlorprothixene (316.0921 m/z) mixture with $\Delta m/z = 0.0622$.

Frequency response profile of the total energy loss,
$q = 0.706$, $V_{exc} = 20$ mV, $t_{exc} = 10$ ms,
P = 5.0e-5 Torr, $\sigma = 175$ $A^2$, 322 m/z Frequency response profile of the total energy loss,
1.228484 MHz, $V_{exc}$ = 20 mV, $t_{exc}$ = 10 ms,
P = 5.0e-5 Torr, $\sigma$ = 175 $A^2$, 322 m/z Frequency response profile of the total energy loss,
$q$ = 0.706, $V_{exc}$ = 20 mV, $t_{exc}$ = 10 ms, P = 5.0e-5 Torr

HIGH RESOLUTION EXCITATION/ISOLATION OF IONS IN A LOW PRESSURE LINEAR ION TRAP

CROSS-REFERENCE TO RELATED APPLICATIONS

This application is a continuation of U.S. application Ser. No. 12/240,060, filed on Sep. 29, 2008, which claims the benefit of U.S. Provisional Application No. 60/986,687, filed on Nov. 9, 2007, both of which are incorporated herein by reference in their entireties.

INTRODUCTION AND SUMMARY

The present subject matter relates to mass spectrometry and ion separation, and in particular to methods of improving the ion detection resolution of mass spectrometers and other ion trap-based ion separation devices.

In mass spectrometry (MS) generally, a mass spectrometer is used to isolate and fragment an ion species of interest, and to detect daughter ions resulting from the fragmentation. In some systems, a quadrupole-linear ion trap (QqQ-LIT) mass spectrometer is employed to hold a population of ions that arrive in the trap from the triple quadrupole, and to apply a selected excitation voltage to that trapped population in order to fragment the ion of interest. Those fragments are then scanned from the trap to the detector. The amplitude of the applied excitation voltage for an ion of interest is linearly related to the ion's mass-to-charge ratio (m/z), as described, e.g., in U.S. Pat. No. 6,124,591 to Schwartz et al.

Improvements have been made in the mass spectrometry resolution of trapped ions. See, e.g., B. A. Collings et al., "A combined linear ion trap time-of-flight system with improved performance and MSn capabilities" *Rapid. Comm. Mass Spec.* 15(19):1777-1795 (Oct. 15, 2001). Further improvement in resolution is also desirable.

SUMMARY OF THE INVENTION

The present subject matter provides methods and apparatus capable of implementing them, which methods offer increased resolution of an ion or ions of interest present in an ion-trap-contained ion population. These include mass spectrometry methods and mass spectrometers therefor, that employ a low vacuum pressure linear ion trap and low amplitude ion excitations. In some embodiments, ions within about 2 mass/charge (m/z) units or less of the m/z value for an ion of interest can be fragmented in the trap and those fragments can be effectively removed from the trapped ion population, prior to fragmenting the ion(s) of interest. Various embodiments hereof further provide:

Methods for mass spectrometry involving providing an excitation q value that is greater than zero and less than 0.908, and maintaining an ion trap of a mass spectrometer under vacuum pressure of 1 mTorr or less while (a) introducing an ion population into the trap, the ion population including an ion of interest; (b) applying a resolving direct current to the ion trap for a time sufficient to isolate from the trapped ion population an ion subpopulation within a window of about 10 m/z or less, the ion subpopulation including the ion of interest; and one of (c) or (d), which are:

(c) when the m/z of the ion of interest is above the low-mass cut-off determined by the excitation q, performing a high-resolution fragmentation excitation by applying an excitation signal to the ion of interest, at an excitation amplitude (V) that is from about 1 mV to 100 mV for a time sufficient to generate fragment ions that arise from a mass window having a width of 2 m/z or less and being centered on the ion of interest, the excitation amplitude (V) being about 0.05 to about 10 mV above a minimum that is the threshold amplitude for the onset of ion-of-interest fragmentation, and the fragment ions including fragment ions of the ion of interest; and (d) when the m/z of the ion of interest is below or equal to the low mass cut-off determined by the excitation q, performing a high-resolution isolation, followed by a fragmentation, by (1) applying an excitation signal to the ion subpopulation to remove any ions, other than the ion of interest, from the subpopulation that have a mass/charge ratio (m/z) that is within 2 m/z or less of the ion of interest, at an excitation amplitude (V) that is from about 1 mV to 100 mV for a time sufficient to generate fragment ions that arise from a mass window having a width of 2 m/z or less and being centered on the ion of interest, the excitation amplitude (V) being about 0.05 to about 10 mV above a minimum that is the threshold amplitude for the onset of fragmentation of those ions, while retaining the ion of interest unfragmented in a remaining ion subpopulation in the ion trap; and thereafter (2) decreasing the excitation q to a reduced value, greater than zero, that permits the m/z of the ion of interest to be above the low mass cut-off determined by that reduced value; and thereafter (3) applying an excitation signal to the remaining ion subpopulation, at a sufficient excitation amplitude (V) and for a time sufficient to generate fragment ions from the ion of interest, the excitation amplitude (V), the time, or both, being the same as or different from that of step (c).

Such methods in which the resolving direct current of step (b) is applied for a time of at least or about 10 microseconds, or at least or about 100 microseconds, or for a time of about 1 ms; such methods in which the excitation signal of step (c) or (d) is applied for a time of at least or about 10 ms, or about 50 ms; such methods in which the ion trap is operated at a drive frequency that is from about 500 kHz to about 10 MHz, or from about 2 MHz to about 5 MHz; such methods in which the excitation amplitude (V) of step (c) or (d1) of the method is at least 5 mV and less than 100 mV, or about 10 mV or less; such methods in which the excitation amplitude (V) of step (c) is about 0.05 to about 5 mV above that threshold amplitude; and such methods in which the ion trap is a linear ion trap of a triple quadrupole mass spectrometer.

Such methods in which the ion subpopulation of step (b) contains two or more ions of interest, including first and second ions of interest, and step (c) or (d) involves (i) applying a first excitation signal to the ion subpopulation to generate fragment ions from the first ion of interest, and (ii) thereafter applying a second excitation signal, different from the first excitation signal, to the ion subpopulation to generate fragment ions from the second ion of interest.

Such methods in which step (c) or (d) further involves, after (i) and before (ii), scanning out from the ion trap fragment ions generated from the first ion of interest, while leaving in the ion trap an ion subpopulation that includes the second ion of interest.

Such methods in which the excitation q of step (c) or the reduced excitation q of step (d2) is from about 0.4 to 0.907; such methods in which the vacuum pressure is about $5\times10^{-5}$ Torr or less; such methods in which the window of step (b) is about 5 m/z or less; such methods in which, after performing step (c) or step (d), ions are scanned ions out from the ion trap and scanned-out fragment ions of the ion of interest are detected.

Such methods in which step (d1) involves (i) applying a notched waveform that is capable of fragmenting ions of the subpopulation that have a mass/charge ratio (m/z) that is within 2 m/z of the ion of interest, while leaving the ion of interest unfragmented, the notched waveform being made up of waveform components that each independently have an amplitude of about or less than 10 mV, and being applied for a sufficient time to generate fragments of those ions other than the ion of interest, and (ii) applying a resolving direct current to the ion trap for a time sufficient to eject fragments generated thereby, while leaving in the ion trap a remaining ion subpopulation that includes the ion of interest. Such methods in which each of the waveform components independently has an amplitude of about 1 mV or more; such methods in which the notched waveform is applied for a time of at least or about 10 ms.

Such methods in which step (d1) involves (i) applying a series of notched waveforms, each of which is capable of fragmenting an ion or ions of the subpopulation that have a mass/charge ratio (m/z) that is within 2 m/z of the ion of interest, while leaving the ion of interest unfragmented, each of the notched waveforms being made up of waveform components that each independently have an amplitude of about or less than 10 mV and being applied for a sufficient time to generate fragments of an ion or ions other than the ion of interest, and (ii) applying a resolving direct current to the ion trap for a time sufficient to eject fragments generated thereby, while leaving in the ion trap a remaining ion subpopulation that includes the ion of interest. Such methods in which each of the waveform components independently has an amplitude of about 1 mV or more; such methods in which each of the notched waveforms is applied for a time of at least or about 10 ms.

Such methods in which the ion subpopulation of step (b) contains two or more ions of interest, including first and second ions of interest, the step (d1) of applying an excitation signal involves applying radial excitation to the ion trap to remove ions from the subpopulation that have a mass/charge ratio (m/z) that is within 2 m/z of each of the ions of interest, while retaining in the ion trap a remaining ion subpopulation that includes the ions of interest, and step (d3) involves (i) applying a first excitation signal to the ion subpopulation to generate fragment ions from the first ion of interest, and (ii) thereafter applying a second excitation signal, different from the first excitation signal, to the ion subpopulation to generate fragment ions from the second ion of interest. Such method in which step (d3) further involves, after (i) and before (ii), scanning out, from the ion trap, fragment ions generated from the first ion of interest, while leaving in the ion trap an ion subpopulation that includes the second ion of interest.

Such methods in which the excitation signal of step (d1) removes ions that have a m/z ratio that is within about 1 m/z of the ion of interest, thereby providing an isolation having a resolution of about or less than 1 m/z; or removes ions that have a m/z ratio that is within about 0.1 m/z of the ion of interest, thereby providing an isolation having a resolution of about or less than 0.1 m/z.

Such methods in which step (d1) involves (i) applying conditions capable of fragmenting those ions having a mass/charge ratio (m/z) that is within 2 m/z of the ion of interest, followed by (ii) applying a resolving direct current to the ion trap to remove fragments generated thereby, while retaining in the ion trap a remaining ion subpopulation that includes the ion of interest.

Mass spectrometry apparatus containing an ion trap under a vacuum pressure of about 1 mTorr or less, the ion trap being operable to contain an ion population for a period of time sufficient to isolate therefrom a subpopulation of ions that includes an ion of interest and that is within a window of about 10 m/z or less; and a programmable controller operably coupled to the ion trap, the programmable controller being programmed with an algorithm including instructions for the controller: (a) to apply a resolving direct current to the ion trap for a period of time sufficient to isolate the subpopulation of ions within that window; and one of (b) or (c), which are:

(b) when the m/z of the ion of interest is above the low-mass cut-off determined by a retrieved-from-storage, user-inputted, or calculated-from-user-input excitation q value, the excitation q value being greater than zero and less than 0.908, to apply an excitation signal to the ion of interest, at an excitation amplitude (V) that is from about 1 mV to 100 mV for a time sufficient to generate fragment ions that arise from a mass window having a width of 2 m/z or less and being centered on the ion of interest, the excitation amplitude (V) being about 0.05 to about 10 mV above a minimum that is the threshold amplitude for the onset of ion-of-interest fragmentation, and the fragment ions including fragment ions of the ion of interest; and (c) when the m/z of the ion of interest is below or equal to the low mass cut-off determined by a retrieved-from-storage, user-inputted, or calculated-from-user-input excitation q value, the excitation q value being greater than zero and less than 0.908, (1) to apply an excitation signal to the ion subpopulation to remove any ions, other than the ion of interest, from the subpopulation that have a mass/charge ratio (m/z) that is within 2 m/z or less of the ion of interest, at an excitation amplitude (V) that is from about 1 mV to 100 mV for a time sufficient to generate fragment ions that arise from a mass window having a width of 2 m/z or less and being centered on the ion of interest, the excitation amplitude (V) being about 0.05 to about 10 mV above a minimum that is the threshold amplitude for the onset of fragmentation of those ions, while retaining the ion of interest unfragmented in a remaining ion subpopulation in the ion trap; and thereafter (2) to decrease the excitation q value to a retrieved-from-storage, user-inputted, or calculated-from-user-input reduced value, greater than zero, that permits the m/z of the ion of interest to be above the low mass cut-off determined by that reduced value; and thereafter (3) to apply an excitation signal to the remaining ion subpopulation, at a sufficient excitation amplitude (V) and for a time sufficient to generate fragment ions from the ion of interest, the excitation amplitude (V), the time, or both, being the same as or different from that of step (b).

Such apparatus in which the algorithm includes instructions to perform any of the above-described methods. Such apparatus in which the algorithm includes instructions for the controller to obtain, and to load into active memory, values, for use in step (a) and in either step (b) or step (c), for: (1) the resolving direct current of step (a); (2) the application time for the resolving direct current of step (a); (3) the excitation amplitude (V) of step (b) or excitation amplitudes (V) of step (c); (4) the time for applying the excitation signal of step (b) or the excitation signals of step (c); and (5) the mass(es) of the ion(s) of interest; and one of (6) or (7), which are (6) the excitation q of step (b), or both the excitation q and the reduced excitation q of step (c), and (7) all three of (i) the drive frequency, (ii) the drive radio frequency (RF or rf) amplitude, and (iii) the field radius, with (7) being obtained where the algorithm further includes instructions to calculate from the values thereof the excitation q value of step (b) or step (c), Such apparatus in which each of the instructions to obtain the values involves an instruction to retrieve the values from stored memory or to request and receive the values as input from a user, or any combination thereof; and such apparatus in which the algorithm further includes instructions for the controller to calculate, from (A) the excitation q value divided by 0.908 and (B) the mass of the ion of interest: (1) the low-mass cut-off of step (b); or (2) one or both of (i) the low-mass cut-off of step (c), and (ii) using the reduced excitation q value, divided by 0.908, as (B) in that calculation, the low-mass cut-off of step (c2).

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 1 presents a set of resonance excitation profiles for the 195 m/z precursor of caffeine as a function of excitation q, using the profile at q=0.235 as a reference. Excitations at q=0.147, 0.205, 0.235, 0.304, and 0.393 are shown.

Figure 2:
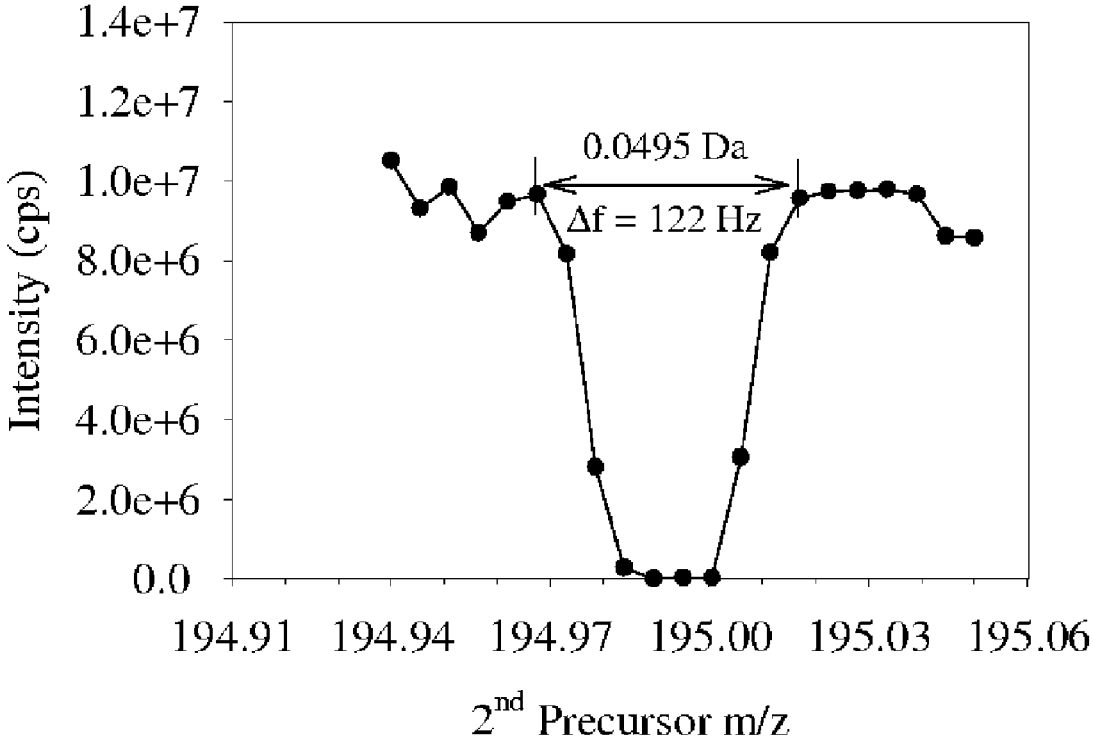

FIG. 2 presents a resonance excitation profile for caffeine (195 m/z) employing q=0.706.

Figure 3:
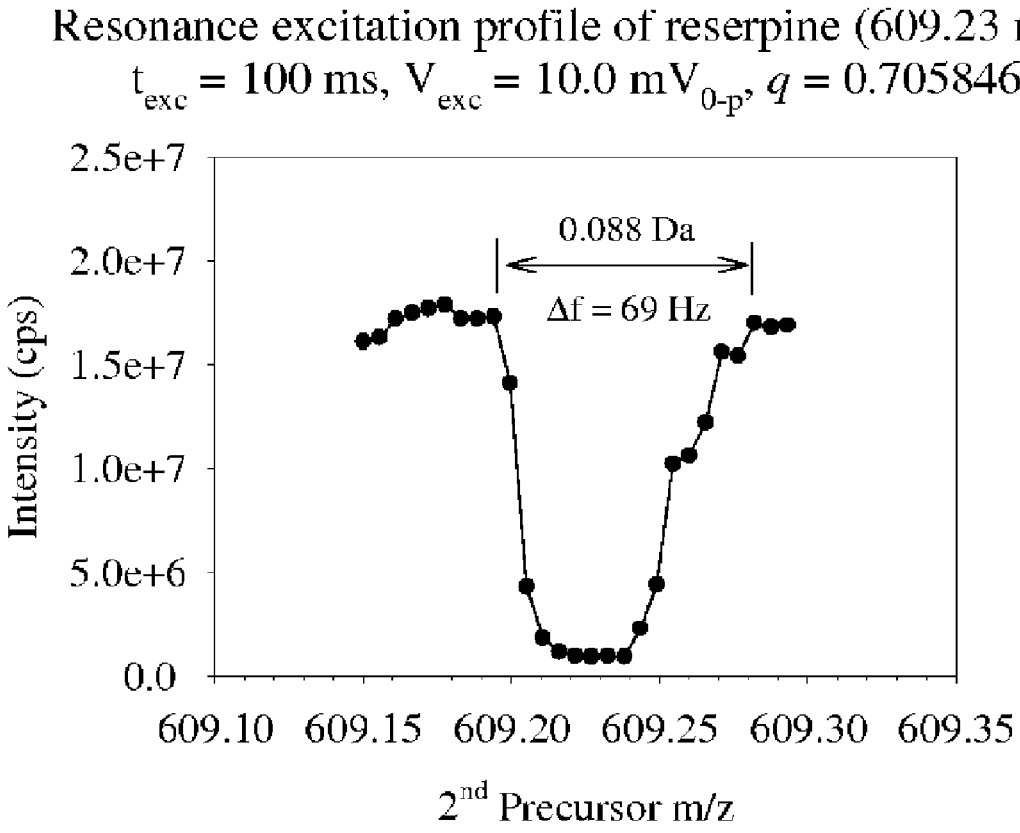

FIG. 3 presents a resonance excitation profile for reserpine (609.23 m/z) employing q=0.706.

Figure 4:
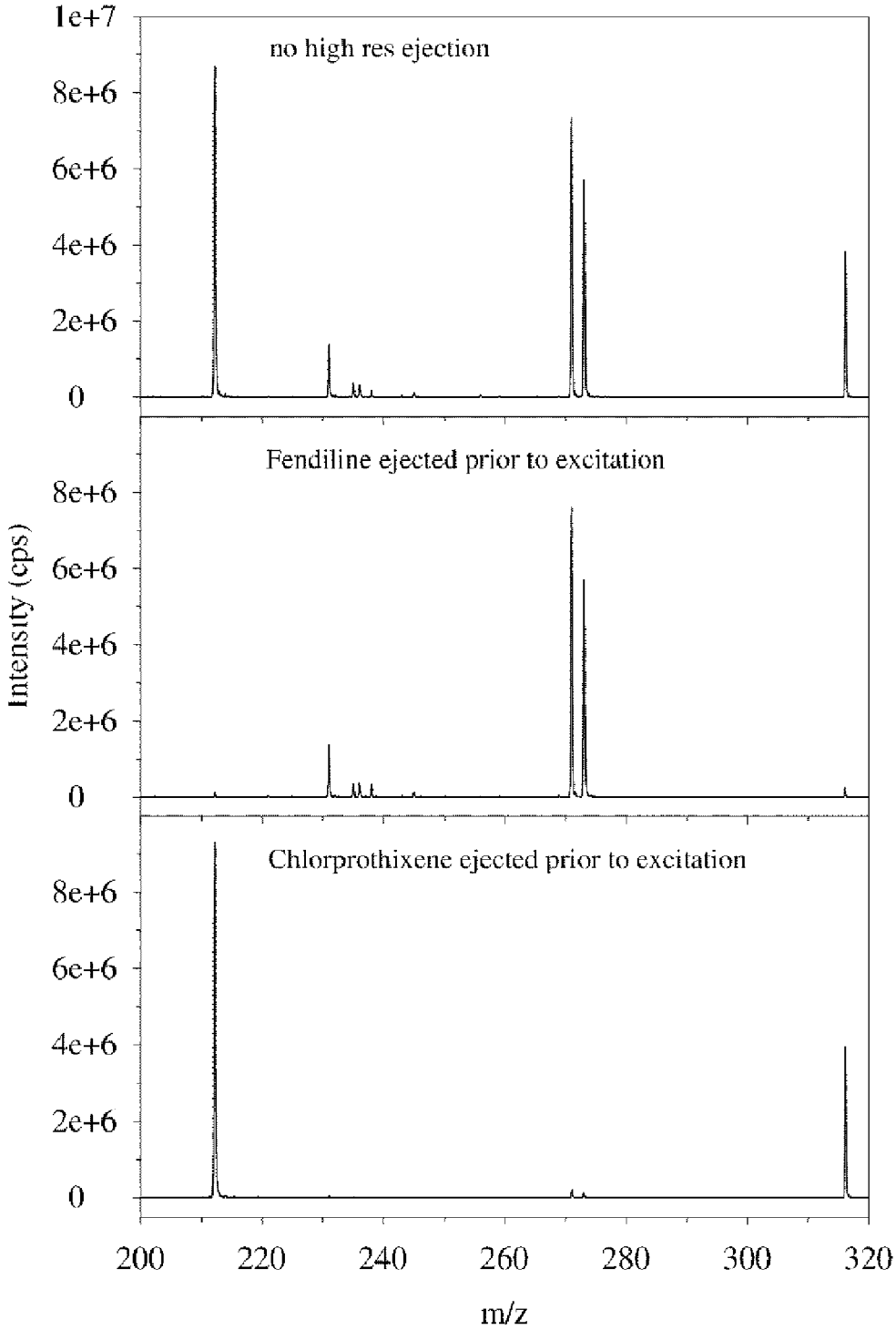

FIG. 4 presents detector results for detection of fragments from a mixture of fendiline and chlorprothixene, which have respective m/z values of 316.206 and 316.0921, i.e. 0.1139 m/z apart. Results of methods performed both without (top trace) and with (middle and bottom traces) a fragmentation and ejection step to eliminate competing ions are shown.

Figure 5:
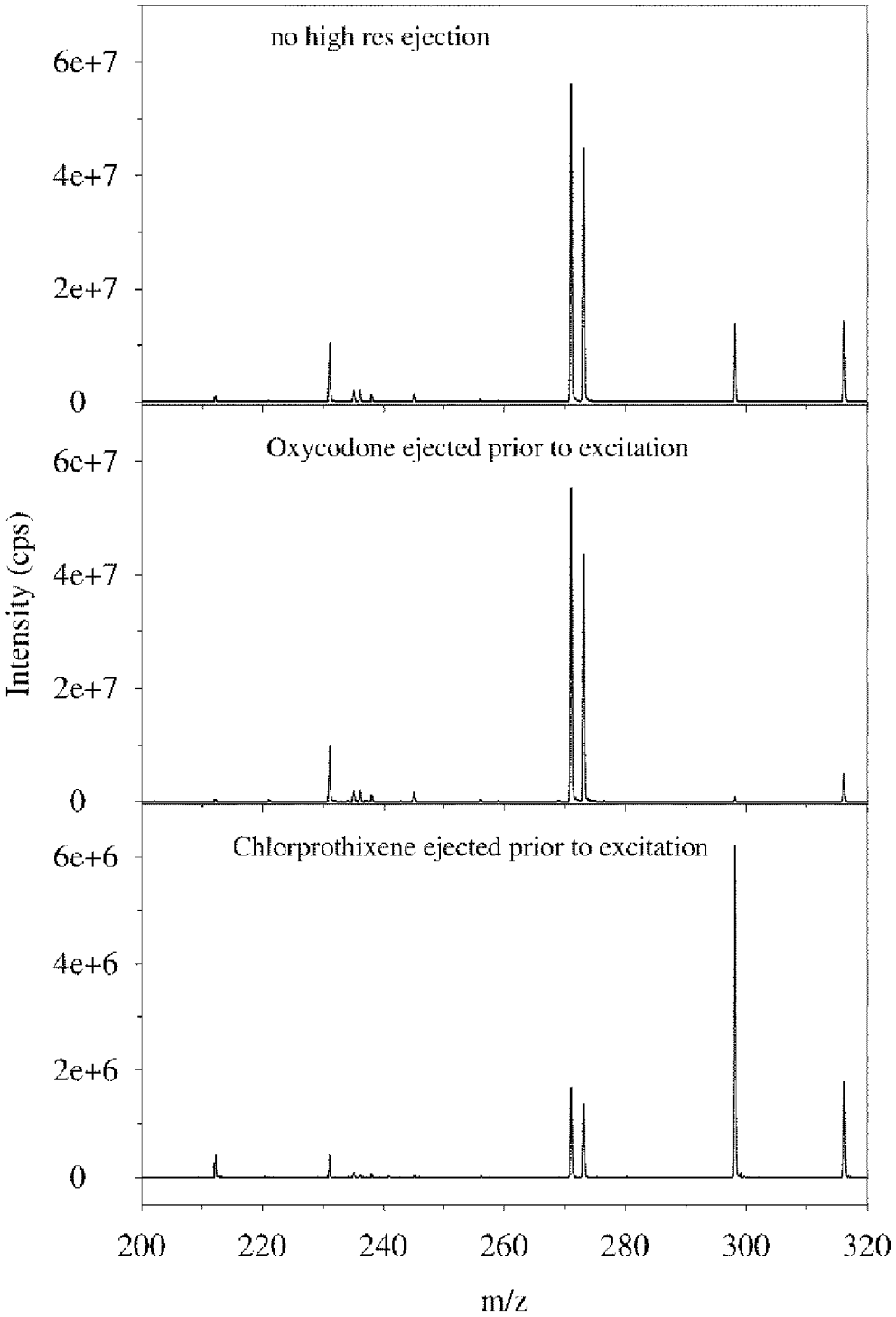

FIG. 5 presents detector results for detection of fragments from a mixture of oxycodone and chlorprothixene, which have respective m/z values of 316.1543 and 316.0921, i.e. 0.0622 m/z apart. Results of methods performed both without (top trace) and with (middle and bottom traces) a fragmentation and ejection step to eliminate competing ions are shown.

Figure 6:
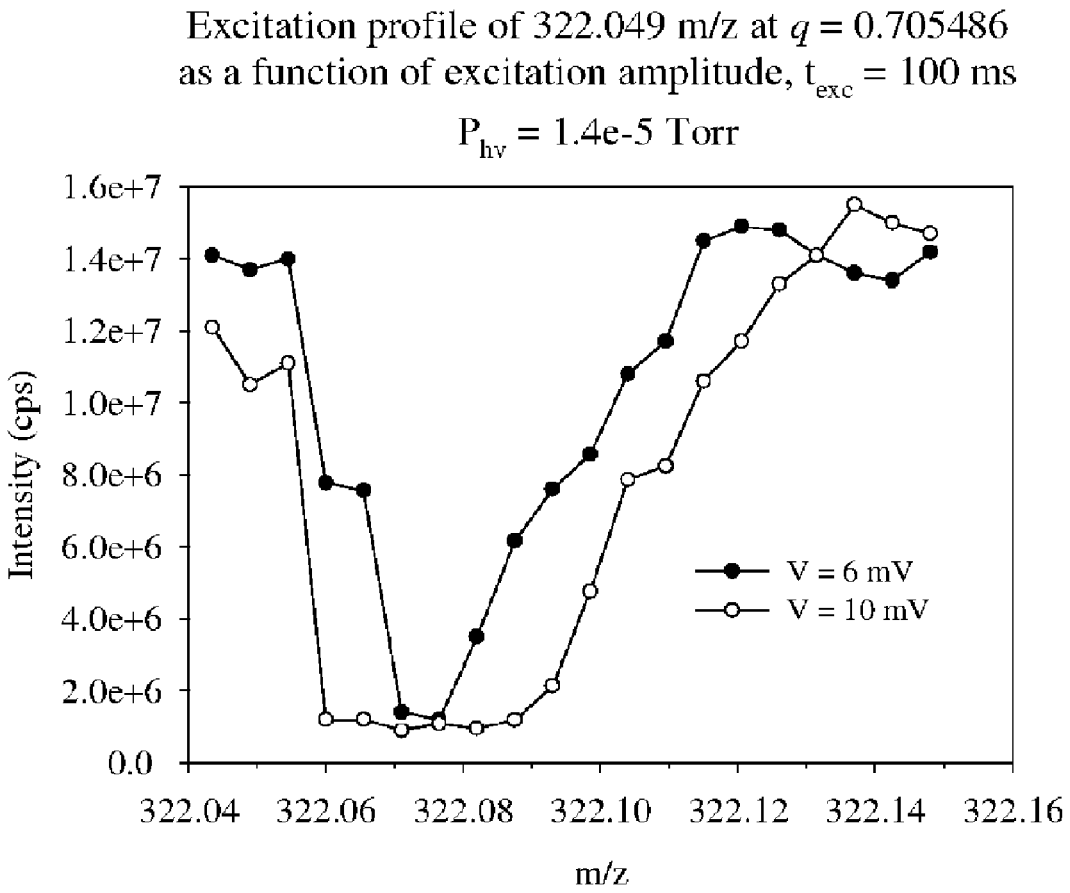

FIG. 6 presents a model excitation profile of an ion having an m/z value of 322.049, evaluating excitation as a function of excitation amplitude at both 6 mV (●) and 10 mV (○).

Figure 7:
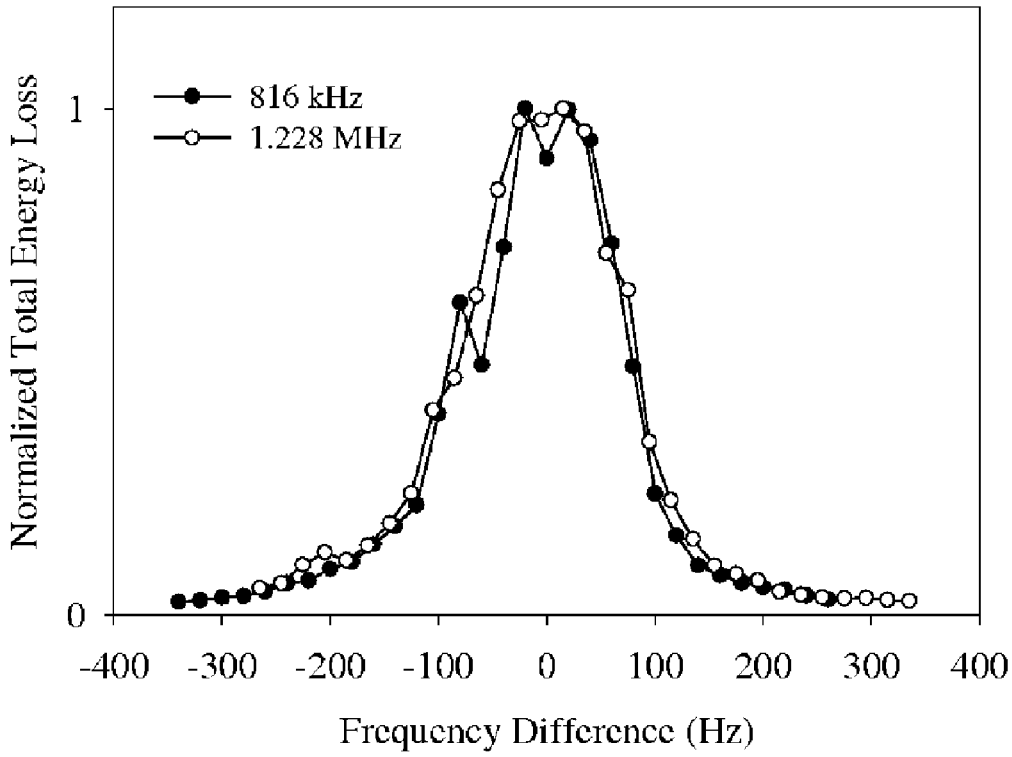

FIG. 7 presents a model frequency response profile of the total energy loss for excitation of an ion having a 322 m/z value, evaluated at ion trap drive frequencies of 816 kHz (●) and 1.228 MHz (○).

Figure 8:
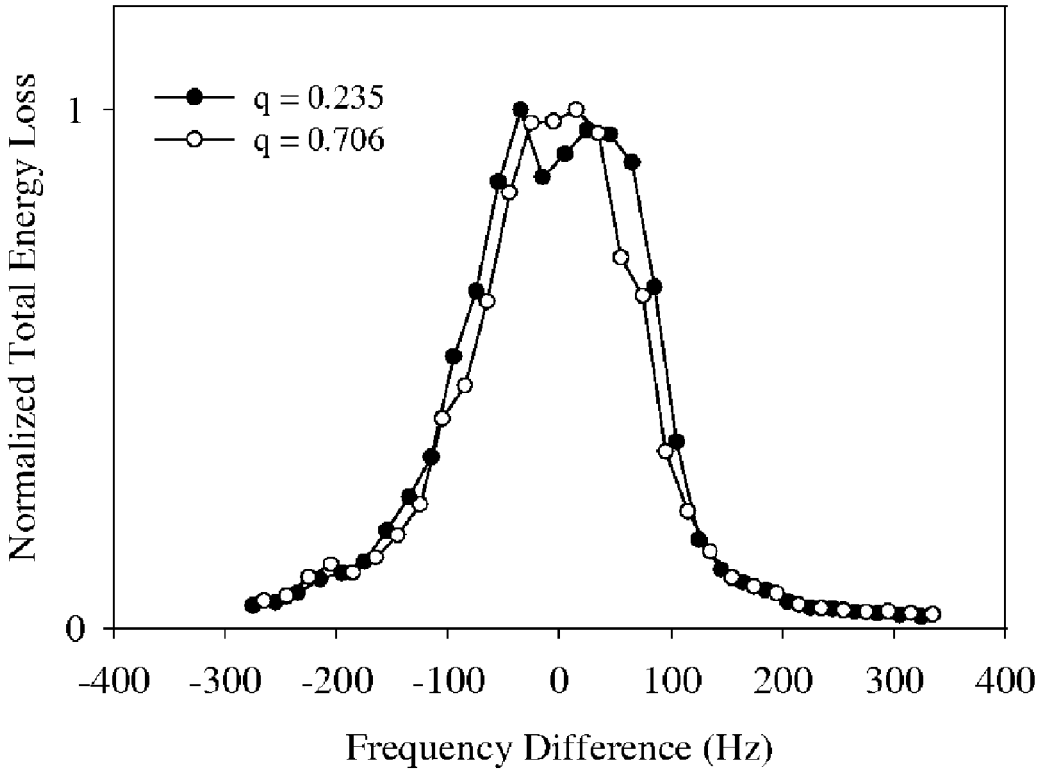

FIG. 8 presents a model frequency response profile of the total energy loss for excitation of an ion having a 322 m/z value, evaluated at different q values of 0.235 (●) and 0.706 (○), while maintaining the drive frequency at 1.228 MHz.

Figure 9:
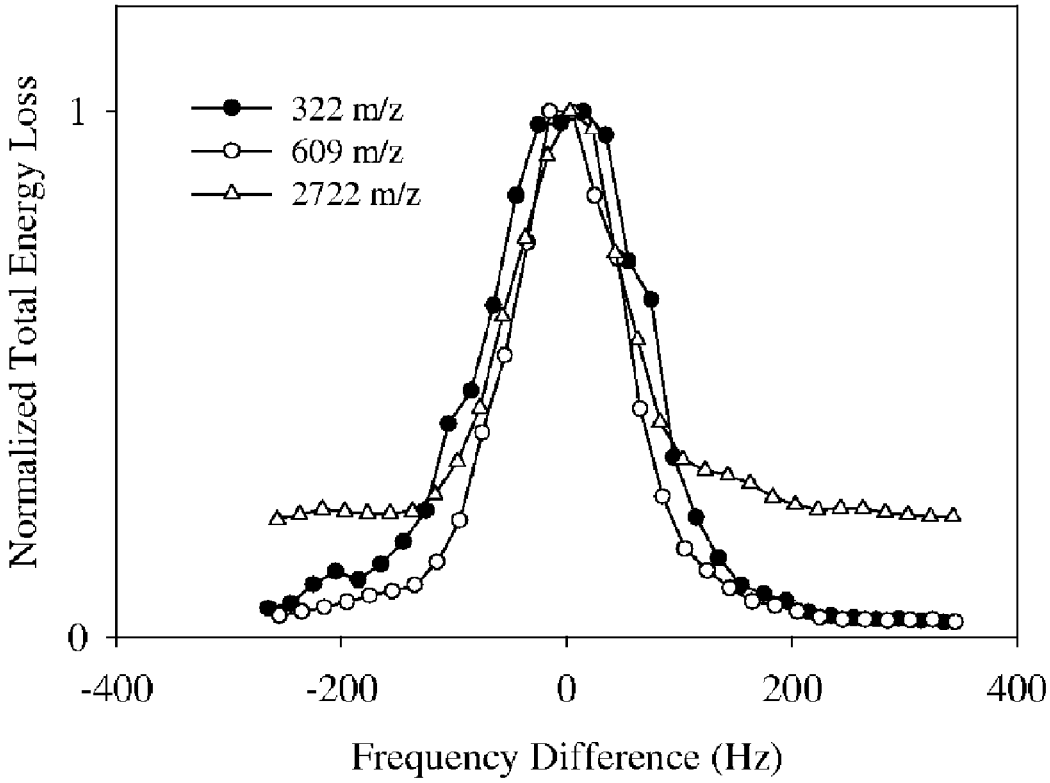

FIG. 9 presents a model frequency response profile of the total energy loss for excitation of three ions having respective m/z values of 322 (●), 609 (○), and 2722 (Δ).

Figure 10:
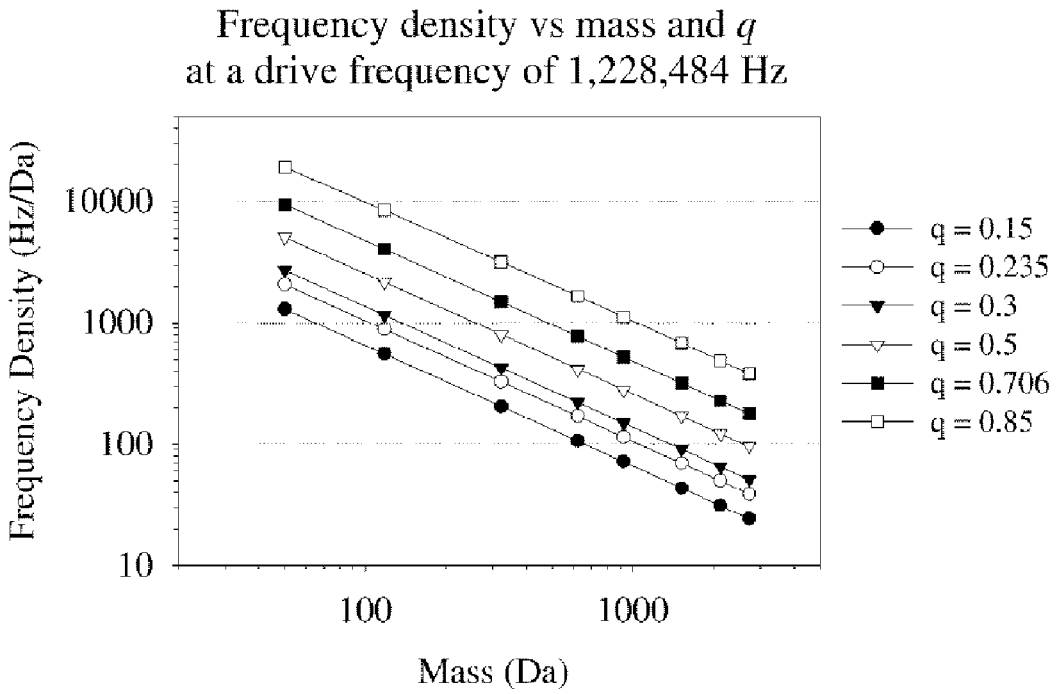
Figure 10:
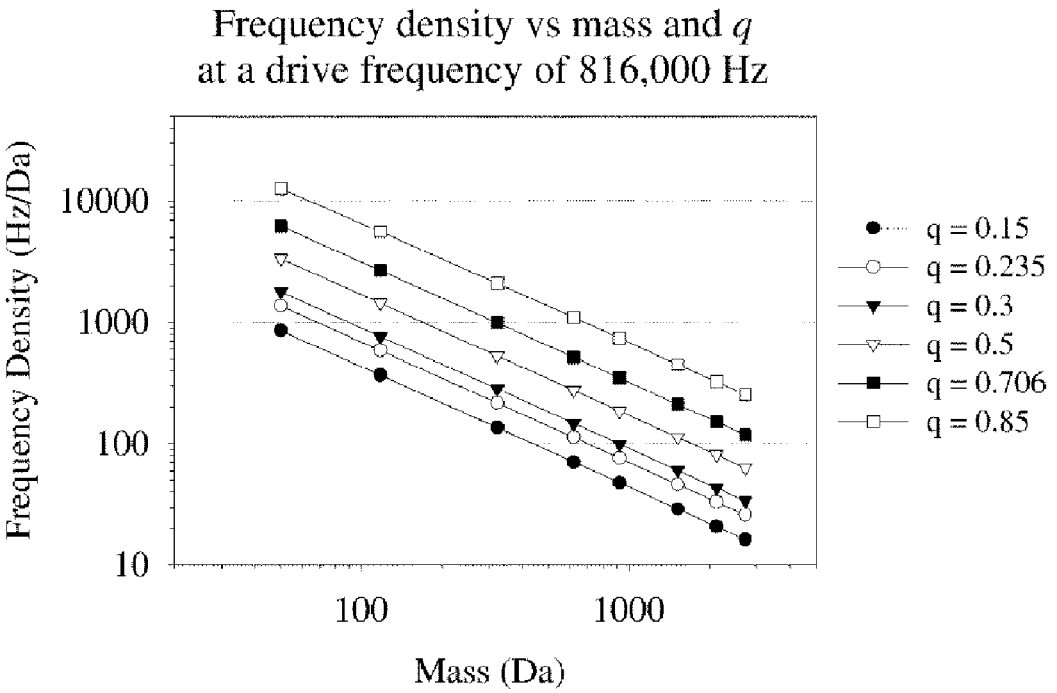

FIG. 10 presents plots of frequency density (Hz/Da) as a function of mass for ions of various q values, at drive frequencies of 1.228484 MHz (upper plot) and 816 kHz (lower plot). Ion q values evaluated were 0.15 (●), 0.235 (○), 0.3 (▼), 0.5 (▽), 0.706 (■), and 0.85 (□).

Figure 11:
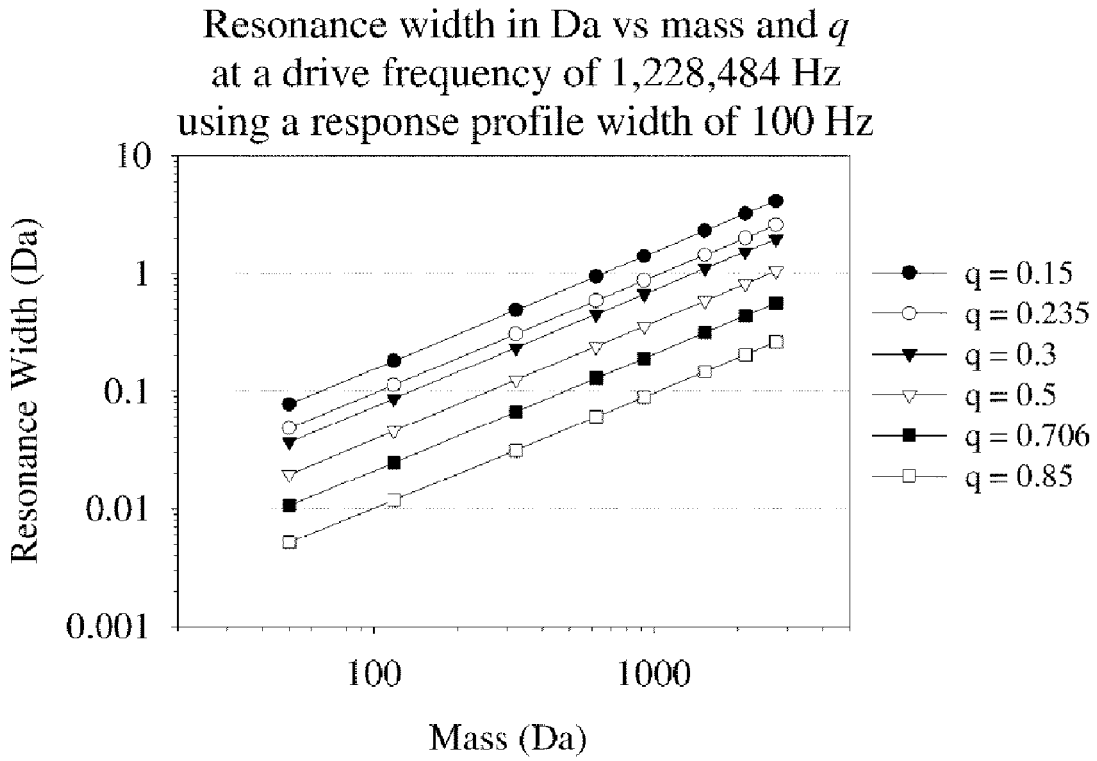
Figure 11:
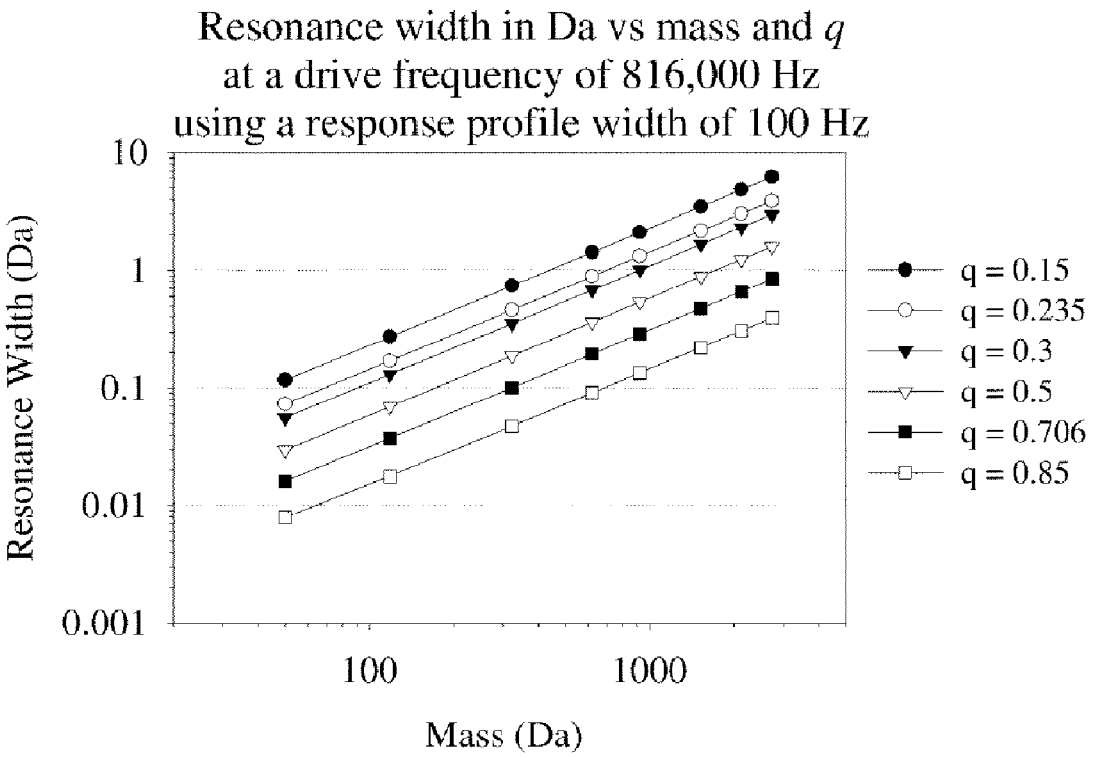

FIG. 11 presents plots of resonance widths as a function of mass, for ions of various q values, at drive frequencies of 1.228484 MHz (upper plot) and 816 kHz (lower plot). Ion q values evaluated were 0.15 (●), 0.235 (○), 0.3 (▼), 0.5 (▽), 0.706 (■), and 0.85 (□).

DETAILED DESCRIPTION

The following description is merely exemplary in nature and is not intended to limit the present disclosure, application, or uses.

The present subject matter employs an ion trap that is held under low pressure, and application of ion excitation signals at low amplitudes to excite and fragment trap-resident ions held under such low pressure conditions. Combinations of low pressure and low amplitude have been found capable of providing improved resolution for isolation or fragmentation of ions of interest from a mixed population of trap-resident ions. The low-pressure, low-amplitude excitations cause ion fragmentation to occur.

This technique can be employed to fragment an ion of interest for recovery or for detection of its fragments, or to fragment one or more other ions having m/z value(s) close to that of an ion of interest so as to allow removal of such neighboring ions prior to fragmentation of the ion(s) of interest. Ions having m/z values that are close in m/z value to that of the ion of interest can also be referred to herein as "neighboring" ions. This technique can also be employed in two ways to both remove such target-ion-neighboring ions from the trap-resident ion population and to fragment the target ion of interest in the remaining, trap-resident ion subpopulation.

In some embodiments, these features can be employed to more selectively fragment an ion or ions of interest, directly from an ion trap-resident ion population, to generate fragments that can be scanned from the trap for detection, for recovery or use such as by ion bombardment or ion implantation (e.g., on a metal, silicon, ceramic, glass, or plastic substrate, such as the technique described in U.S. Pat. No. 6,670,624 to Adams et al.), or for further analysis such as by further fragmentation or fragment isolation as may be performed using a tandem MS/MS system.

In an embodiment of a method hereof, a population of ions is loaded into an ion trap. The ion trap can, in some embodiments, be an ion trap of a mass spectrometer, such as a linear ion trap of a quadrupole mass spectrometer. In operation, the ion trap is maintained under a vacuum pressure of 1 mTorr or less. The low-pressure atmosphere can be an ambient atmosphere, or it can be and more typically is an inert gas, such as nitrogen or a noble gas, e.g., helium or argon. The vacuum pressure can be about or less than 800, 500, 300, 200, 100, 80, 50, 30, 20, or 10 μTorr. In some embodiments, the vacuum pressure can be about 50 μTorr. In some embodiments, the vacuum pressure can be about or at least 1 μTorr.

The ion trap can be operated at a drive frequency that is about or at least 500 or 750 kHz, or about or at least 1, 1.5, 2, or 2.5 MHz. The drive frequency can be about or less than 10, 7.5, or 5 MHz. For example, the drive frequency can from about 500 kHz to about 10 MHz, or from about 2 MHz to about 5 MHz.

After loading into the ion trap, the trapped population of ions is treated to isolate a subpopulation of ions thereof, the remaining ions being expelled from the ion trap, e.g., either by decomposing through collisions with the gas atmosphere or by otherwise being ejected. The isolation of the ion subpopulation can be performed by applying a resolving direct current (DC) that is capable of removing ions outside of, while retaining in the trap ions within, a desired m/z window. The m/z window can be, e.g., approximately a 10 m/z unit window that encompasses at least one ion of interest, although other size windows can be employed. Thus, in some embodiments, an approximately 8 m/z, 6 m/z, 5 m/z, 4 m/z, or other m/z window can be used.

The resolving DC is applied for a sufficient time to remove ions outside the selected m/z window. Thus, the resolving DC can be applied for, e.g., can be applied for a time of at least or about 10 microseconds; in some versions of the technology, the resolving DC can be applied for at least or about 100 microseconds, or for about 1 ms. Longer times can be, but need not be, used.

Useful techniques for resolving DC include those described, e.g., in P. N. Dawson, *Quadrupole Mass Spectrometry and Its Applications,* 1995, (American Institute of Physics (AIP) Press). The voltages, frequencies, and other parameters therefor can be determined according to the Mathieu parameters a and q which define the regions of stability for a quadrupole mass filter. These can be calculated using equations (1) and (2):

$$a = \frac{8eU}{mr_0^2\Omega^2}; \text{ and} \tag{1}$$

$$q = \frac{4eV}{mr_0^2\Omega^2}; \tag{2}$$

where m is the mass of the ion, e is the coulombic charge, $r_0$ is the field radius of the quadrupole and Ω is the angular drive frequency of the quadrupole. The magnitude of the DC volts applied is represented by U and the amplitude of the RF (pole to ground) is represented by V. The isolation windows can typically be about a=0.23 and q=0.706. There will be a range of a and q that covers a particular window width.

Once the population of trapped ions has been narrowed to the desired window defining a range of ions that includes an ion of interest, such ion(s) of interest can be fragmented and those fragments can be scanned out of the trap, e.g., through a lens or filter, leading to a detector, a subsequent treatment chamber or apparatus, or any other desired destination. Where more than one ion of interest is present in the subpopulation remaining in the trap, each of these can be fragmented within and scanned out of the trap, one-at-a-time in sequence, or these can all be fragmented and the pool of ion-of-interest fragments can then be scanned out of the trap.

Excitation signals are applied at a given excitation q value, the excitation q value being the value of the Mathieu q, which can be determined from the Mathieu equation. An excitation signal is a combination of the excitation frequency and amplitude applied to an ion. An excitation signal that is applied to fragment an ion of interest hereof can be applied at an excitation q value that is from about 0.4 to 0.907, or that is at least or greater than 0.4 and up to or less than 0.907. As is well known, the excitation frequency of the excitation signal can be determined as a function of the Mathieu q value and the drive frequency at which the ion trap is being operated.

As is well known to one of ordinary skill in the art, during operation of an ion trap under any one set of conditions, the value of excitation q (the Mathieu q) is associated with a given m/z value, referred to as a "cut-off" value, that can be used to distinguish the trapped ions into "low mass" ions, whose m/z values are below that of the cut-off m/z value, and "high mass" ions, whose m/z values are above that of the cut-off m/z value. In various contexts, such a "cut-off" m/z value can be referred to as a "low-mass cut-off" value. Thus, during operation of an ion trap under any one set of conditions herein, the value of excitation q can be said to determine the "low-mass cut-off" value for the trapped ion population. As is well known in the art, the low-mass cut-off value can be calculated from the excitation q value divided by 0.908 and the mass of the ion of interest.

Radial Excitation Clean-Up

In some embodiments, prior to fragmentation of the ion(s) of interest, the trap-resident ion (sub)population can be treated, e.g., to remove ions having m/z values that are close to that of the ion(s) of interest, while retaining the ion(s) of interest in the trap. In such a treatment step, a radial excitation clean-up step can be performed to remove such neighboring ions.

Thus, in various embodiments of methods hereof, a radial excitation clean-up step can be performed to remove from the trap ions that have a m/z ratio whose value is within 10 or 5 m/z units of the m/z value of an ion of interest, and the subsequent fragmenting excitation that is applied to the remaining subpopulation of trap-resident ions to fragment the ion(s) of interest can generate fragments of the ion of interest that can be scanned out from the trap with a corresponding resolution of about 10 or 5 m/z units, respectively. However, various embodiments of methods hereof surprisingly can be performed so as to remove ions from an even narrower range, and to provide even greater resolution, of about or less than 4, 3, 2, 1, 0.5, or 0.1 m/z; or about 0.05 m/z or more. These values represent the width of the resonance in m/z space. This means, e.g. in the lattermost case, that two ions can be as close as 0.05 m/z to each other and when the excitation is applied to one ion, the other ion will not be affected, i.e. during fragmentation, one ion gets fragmented and the other does not.

The radial excitation can be performed in any of a variety of ways. In some embodiments, a notched waveform can be used to excite and fragment multiple ions having m/z values neighboring that of the ion of interest, or neighboring those of the ions of interest. In some embodiments, a series of notched waveforms can be used, in which each of the notched waveforms is applied to excite and fragment, e.g., one or a few of such neighboring ions at a time.

Where a notched waveform is used, this waveform is designed to fragment only neighboring ion(s) within the desired range of neighboring ions, and thus it excludes an excitation signal or signals for the ion(s) of interest within that desired range. The waveform components making up a notched waveform hereof can each independently have an amplitude of about or less than 10 mV, and this can be about or greater than 1 mV. For example, a notched waveform that has an amplitude of 10 mV and contains 100 frequency components, would have an average amplitude of the individual components that is on the order of 0.1 mV. The notched waveform is applied for a time sufficient to fragment the neighboring ion or ions it is intended to fragment. Typically, the notched waveform can be applied for about or more than 10 ms.

For the purposes of eliminating ions not close to, e.g., more than 10 m/z from, an ion of interest, the notched waveform amplitude can be up to a few hundred millivolts, e.g., up to 300, 400, or 500 mV, which could cover several Da for ions of higher masses. For example, fragmentation can occur for excitation amplitudes of up to 500 mV at times of 100 ms for low q, e.g. $0.4 \leqq q << 0.6$, and 200 mV amplitude and 100 ms at q=0.6. For high resolution isolation using the notched waveform, the amplitudes of each individual frequency component can be, e.g., about 200 mV at q=0.6, for masses not close to, e.g., more than 10 m/z from, the mass of the ion of interest. For those frequency components that affect ions close to the mass of interest the frequency components used typically have a decreased amplitude. In contrast, the frequency components closest to the ion of interest are typically on the order of about 10 mV. This also means that the number of frequency components per mass unit is higher because of the narrowness of the response profiles at the low amplitudes. So the notched waveform can contain frequency components that are spaced according to their amplitude and can range from 100 mV amplitude down to about 1 mV amplitude. In various embodiments, the amplitude can be less than 100 mV, and this can be at least, more than, or about 1, 5, or 10 mV and up to, less than, or about 75, 50, 25, or 20 mV, They can be applied for times ranging from 10 ms to 1000 ms, and this can be at least or about 10, 20, 30, or 50 ms, and up to or about 1000, 800, 500, 300, 200, or 100 ms. In various embodiments, a notched waveform can be applied for a time that is from about 50 to about 100 ms at pressures below $5\times10^{-5}$ Torr.

In some alternative embodiments, an excitation/fragmentation technique can be used in which the amplitude of the drive radio frequency (rf) can be ramped up and/or down, while maintaining one frequency, in order to move the secular frequency of a selected neighboring ion so that it comes into resonance with the applied excitation signal, for fragmentation. In this technique, the amplitude is increased and/or decreased within an amplitude range that can be determined from equation (2) for q. This will be dependent on mass, q, drive frequency, and $r_0$. That equation can be re-arranged to give equation (3), V=qmC (3), where C is a constant containing e, $r_0$, and Ω. For two different masses (using the fact that $q_1=q_2$), equation (4) can be derived:

$$\Delta V=(V_2-V_1)=(q_2m_2-q_1m_1)C=\Delta mqC \quad (4);$$

This relationship shows that the voltage difference is proportional to the mass difference. In the example of q=0.8, Ω=1.228 MHz, $r_0$=4.17 mm, and m=1000, we obtain V=2145.9 V. Thus, in this example, a 10 m/z window would have a voltage range of 21.4 V; if the mass of interest were 100 m/z then the mass range would still be 10 m/z and the voltage range would still be 21.4 V; and this would scale with q: if q were half (q=0.4), then the voltage range would be half (10.7 V) to cover the same 10 m/z mass range. As the rf amplitude is scanned from the low mass value to the high mass value, the secular frequency ($\omega_0$) of all the ions increase in a known fashion according to equation (5), $\omega_0=\beta*\Omega/2$ (5), where β is a function of q. As the ion's secular frequency approaches a q value which gives $\omega_0$ equal to the excitation frequency, the ion will be excited and will fragment or be ejected to the rods. In this fashion the excitation frequency can be held constant and the rf amplitude varied to bring the ion's secular frequency into resonance. The range in volts will be determined by the mass range of the isolation window and can be a few tens of volts, e.g., between 10 and 50 V, such as about 20, 25, 30, 35, or 40 V.

Where more than one such neighboring ion is or is suspected to be present, a series of such rampings can be used to excite and fragment the set of selected neighboring ions one at a time. For example, it is possible to ramp over different unwanted masses, in the isolated mass window, using different excitation amplitudes, times and mass ranges. In such an embodiment, lower excitation amplitudes could be employed near, e.g., within 10 m/z of, the ion of interest to obtain a high resolution, and higher excitation amplitudes could be employed, with relatively lower resolution, further away from the ion of interest. In various embodiments using a ramping technique, typically a single ramping is performed through the masses for which elimination in desired.

Other alternative techniques known in the field can similarly be employed to excite and fragment such neighboring ions simultaneously or sequentially. For example, another useful technique is quadrupolar excitation, although this does not appear to provide any further benefit over a dipolar excitation technique. Other useful techniques include those in which excitation is performed using the overtones in either of the above-described dipolar and quadrupolar excitation techniques.

Another example of a possible alternative technique would utilize the edges of the stability boundaries, which technique would involve applying a resolving DC to the ion subpopulation and then ramping the rf amplitude to bring ion(s) close to the edge of the stability boundary. This could be done first for unwanted ions having masses less than that of the ion of interest. Then the rf amplitude could be ramped in the opposite direction to approach the other stability boundary, in order to eliminate unwanted ions having masses greater than that of the ion of interest. An opposite order of those steps can be employed in some embodiments.

Following fragmentation of the selected range of neighboring ions, a resolving DC can be applied to remove fragments produced thereby. In this way, the m/z-space around the ion or ions of interest can be cleared of ion species that in some instances might interfere with recovery or detection of the desired species. In various embodiments, this step of applying a resolving DC can utilize the same resolving DC as was used to isolate the trapped ion subpopulation. The resolving DC employed in the radial excitation clean-up can have parameters identical to those of the resolving DC employed to remove ions outside the m/z window, as discussed above, and can be applied for a similar time.

In both those embodiments that employ a radial-excitation "clean up" step, and those that do not, one or more than one ion of interest can be fragmented and scanned from the ion trap for isolation, detection, and so forth. In some embodiments, this can be done sequentially for more than one ion of interest. Thus, a first excitation can be applied to a first ion of interest to fragment it; then, after it has been scanned from the trap, a second ion of interest can be excited by application of a second excitation to fragment it, following which its fragments can be scanned from the trap; and so forth. In some embodiments, it is possible to sequentially or simultaneously fragment more than one ion of interest and the fragments of both can then be, e.g., simultaneously or sequentially, scanned from the trap.

In some embodiments, in which more than one ion of interest is present in the trapped ion population, any of the above-described radial excitation/fragmentation techniques can be employed to remove ions neighboring a first ion of interest and thereafter, a separate round of excitation/fragment can be performed to remove ions neighboring a second ion of interest, and so forth for third and subsequent ions of interest. In some embodiments, the radial excitation step performed to fragment the ions in the desired m/z-space around each of the ions of interest, can include a post-fragmentation removal of the resulting fragments, e.g., by applying a resolving direct current. In some embodiments, multiple ranges of neighboring ions, each neighboring at least one ion of interest, can be fragmented, and the resulting fragments can be removed simultaneously. This can provide cleaned-up m/z-spaces around two or more ions of interest in the trapped ion population. Those ions of interest can then be fragmented and their fragments scanned from the trap simultaneously, or more typically, each ion of interest can be fragmented and its fragments scanned from the trap, separately from fragmentation and scanning of each of the other ions of interest, in sequence.

In some embodiments, once the fragments of neighboring ions to a given ion of interest have been removed, thereby cleaning up the m/z-space around it, that ion of interest can be fragmented and its fragments can be scanned from the ion trap, prior to both removing neighboring ions from and then fragmenting a second ion of interest.

Fragmentation of Ions of Interest

An ion of interest present in the ion trap is fragmented. Such fragmentation can be performed by applying an excitation signal at a frequency (ω) to the trapped ion subpopulation, at an excitation amplitude (V) that is from about 1 mV to 100 mV, with the excitation amplitude (V) being just above, e.g., at least or about 0.05 mV and up to or about 5 mV above, the minimal threshold amplitude at which the onset of fragmentation of the ion of interest occurs; or in some embodiments about 0.1, 0.5, 1, 1.5, 2, 2.5, or 3 mV above the minimal threshold, up to about 5 mV above the minimum level. This minimum will depend upon the excitation period, the pressure, the excitation q value and the nature of the bonds that need to be broken for fragments to be produced: the lower the pressure, the lower the excitation amplitude threshold for fragmentation. When the pressure gets lower, then the rate of internal energy input also drops and the fragmentation event takes relatively longer to occur. It is important for the rate of internal energy increase to be greater than the rate of thermalization. At the low pressures used herein (e.g., $3.5\times10^{-5}$ Torr) the collision rates are low, e.g.: on the order of about $10^{-4}$ per second. This means that damping and internal energy increases occur as discrete events that happen every 100 or so rf cycles, for a quadrupole operating with a 1 MHz drive frequency. The classical equations for damping of a forced damped harmonic oscillator no longer apply in this situation.

Thus, the pressure of the chamber will define the minimum excitation amplitude that causes fragmentation. The maximum excitation amplitude will also be set by the pressure in the sense that complete ejection of the ion would occur when the ion is ejected before it has had time to fragment. The excitation amplitude employed herein is below the value at which the ion of interest would be ejected in such an unfragmented state. It has been unexpectedly found that excitation amplitudes within this relatively low-value range are not only sufficient to fragment ions of interest, but are capable of doing so in a manner that can provide increased excitation resolution. In various embodiments, the excitation amplitude used can be from about 0.01 to about 10 mV, or at least or about 0.01, 0.05, or 0.1 mV and up to or about 5, 3, 2, or 1, or 0.5 mV. In some embodiments, amplitudes within the lower end of this range, e.g., about or less than 1 mV can be employed to obtain a very high resolution. Higher amplitudes, e.g., on the order of 200-500 mV, which have response profiles covering up to several Da, can be useful in some embodiments, where a wider range of excitation/fragmentation is desired or in embodiments in which a lower resolution excitation/fragmentation is being performed on an ion of interest that has already be isolated using a high resolution technique hereof.

A q value is associated with the m/z of each ion of interest. In some versions of the present technology, useful q values can be those that are from 0.4 to less than 0.907. The excitation amplitude applied at a given q value can be at least or about 1 mV; the amplitude can be about or less than 500 mV. In some embodiments, the excitation amplitude can be about or less than 400, 300, 250, 200, 150, or 100 mV. In some versions hereof, the excitation amplitude can be less than 100 mV, or less than or about 80, 75, 60, 50, 40, 30, 20 or 10 mV. In some embodiments, the amplitude can be at least or about 2, 3, 4, 5, 8, or 10 mV. Thus, in some versions, the excitation amplitude can be from about 5 to about 100 mV; in some versions, the excitation amplitude can be about or less than 10 mV.

In various embodiments, the excitation can be either dipolar excitation or quadrupolar, although other techniques known in the art of exciting ions at (low) amplitudes, i.e. within the present amplitude ranges, can be employed.

The excitation signal is applied for a time sufficient to generate, from the ion of interest, fragment ions that are within an appropriate mass range to allow collection thereof. The excitation signal can be applied for a time of at least or about 10 ms, although values of at least or about 100 ms or 1000 ms can, but need not be used. In some embodiments, a time of about 50 ms can be used for exciting an ion of interest to fragment it.

Following fragmentation of the ion(s) of interest, fragments that are generated thereby can be scanned out of the ion trap. In some versions of the technology, scanning can be performed using either axial or radial ejection. Useful parameters for, and version of, these techniques are know in the art and can be found, e.g., in J. W. Hager, *A new linear ion trap mass spectrometer*, Rapid Commun. Mass Spectrom. 2002, 16, 512-526 (describing axial ejection) and J. C. Schwartz, M. W. Senko and J. E. P. Syka, *A two-dimensional quadrupole ion trap mass spectrometer*, J. Am. Soc. Mass Spectrom. 2002, 13, 659-669.

As noted above, ion fragments that are scanned from the ion trap can be provided for delivery to a detector, a subsequent analyzer, or other desired destination. In some versions of the present technology, the trap can be a linear ion trap (LIT) of a mass spectrometer, such as a triple quadrupole mass spectrometer. The ion trap can be located in either the Q1 or Q3 position of such a triple quadrupole MS apparatus; where it is located in the Q1 position, ion fragments scanned therefrom are further treated or analyzed in the same MS machine. Yet, in other versions of the present technology, the ion trap can be a stand alone trap, a trap in a trap-TOF system, or can be used in any other place that one has the capability of trapping ions at low pressure.

In the case of mass spectrometry, ion fragments scanned from an ion trap hereof can be detected by a detector. Yet, in various embodiments, ions that remain in the ion trap, e.g., a LIT, can also be detected, e.g., using pick-up electrodes to measure image currents in the same manner as this is performed in a Penning trap.

In various embodiments hereof, a low-pressure, low amplitude technique capable of providing high resolution can be used to perform either a high resolution isolation of a subpopulation of ions including an ion of interest, a high resolution fragmentation excitation of an ion of interest, or both. In the context of such a high resolution isolation or fragmentation excitation, the term "resolution" refers to the selectivity toward the ion of interest, and not the resolution of a detector or detection system. Various detectors and detection systems of widely differing resolution capabilities can be usefully employed in various embodiments hereof. Instead, an ion of interest is isolated in a given, relatively narrow window, of about or less than 2 m/z, or is excited for fragmentation therein.

The detector or detection system can operate at a lower resolution than the (higher) resolution of the isolation or excitation that is performed according to an embodiment hereof. For example, an ion of interest can be isolated herein with a resolution giving a 0.1 m/z window. That ion is then fragmented by applying an excitation signal at an appropriate q value to allow the fragments to be trapped. The fragments are thereafter scanned out of the ion trap and can be detected using a detector having a resolution corresponding to, e.g., a 0.7 m/z or other resolution.

Thus, in various embodiments, methods and apparatus hereof can provide a resolution of fragmentation excitation or a resolution of isolation that is about or less than 2 m/z, or about or less than 1, 0.5, 0.1, 0.05, or 0.01 m/z. In some embodiments, both such an isolation and such an excitation can be provided. However, where such a resolution has been provided for isolation of an ion of interest, the conditions used for fragmentation excitation of the ion of interest can be any known useful in the field of mass spectrometry.

Apparatus

Mass spectrometry apparatus, and other ion-trap-containing apparatus, are also provided herein. Such apparatus include a low-pressure ion trap as described above, that is operable to contain an ion population for a time sufficient to isolate a subpopulation of ions therein that are within a desired m/z window that includes an ion of interest, also as described above. Useful apparatus can include a programmable controller operably coupled to the ion trap, the programmable controller being programmed with an algorithm having instructions for the controller to implement an above-disclosed method. In some versions of apparatus hereof, the controller can be programmed with instructions to perform a method hereof in which no radial excitation clean-up step is to be performed; and in other versions, the instructions can be to perform a method that employs such a radial excitation clean-up step.

Thus, in some embodiments, an apparatus hereof has a controller programmed with an algorithm having instructions to (a) apply a resolving direct current to the ion-populated ion trap for a period of time sufficient to isolate an ion subpopulation within the desired m/z window; to (b) apply radial excitation to the ion trap to remove ions from the subpopulation that have a mass/charge ratio (m/z) that is within 2 m/z of the ion of interest, while retaining in the ion trap a remaining ion subpopulation that includes the ion of interest; and to (c) apply an excitation signal to the remaining ion subpopulation, at an excitation amplitude (V) that is from about 1 mV to 500 mV, for a time sufficient to generate, from the ion of interest, fragment ions that can, upon scanning out of the ion trap, be detected with excitation resolutions giving resonance widths of less than 2 m/z, As described above, the actual excitation amplitude (V) employed will be within the range that is defined by a minimum that is the threshold amplitude for the onset of ion-of-interest fragmentation and a maximum that is the minimal threshold amplitude at which ejection of the unfragmented ion-of-interest would occur.

Thus, in some embodiments, e.g., if the window is 10 Da wide, then the use of only a +/−2 m/z radial excitation window misses out on 6 Da of the subpopulation of ions. In fact, this is perfectly acceptable in embodiments hereof, since the excitation of the ion of interest is usually less than 0.5 Da in width. The same principle holds true for embodiments using other window widths and other resolutions hereof, although in various embodiments the radial excitation range can alternatively be wide enough to remove all ions except the ion(s) of interest.

In some versions of the technology, the algorithm can include instructions to obtain data to be used to implement steps (a), (b), and/or (c). In some embodiments, the instruction to obtain such data can include an instruction to retrieve the data from stored memory or to request and receive the data as input from a user, or any combination thereof; and to place that data into active memory.

In the case of step (a), i.e. isolation of an ion subpopulation within a particular m/z window, the instructions can include instructions to obtain values for (1) the endpoints of the m/z window therefor, (2) the resolving direct current to be used therein, and (3) the time to be used for applying that resolving direct current.

In the case of embodiments employing a high resolution isolation step to isolate the ion of interest, the instructions can include instructions to obtain values for (1) the excitation q at which the excitation signals are to be applied in order to perform a high resolution isolation of the ion of interest, and to perform the fragmentation excitation of the isolated ion of interest, (2) the excitation amplitudes (V) to be used in those excitations, (3) the time for applying the isolation and fragmentation excitation signals, and (4) the mass(es) of the ion(s) of interest; In such an embodiment, the instructions for obtaining values for use in performing excitation for high resolution isolation can include to obtain waveform component values or overall waveform value(s) for, e.g., a notched waveform or waveform where that technique is employed.

In the case of embodiments employing a high resolution excitation step to fragment the ion of interest, the instructions can include instructions to obtain values for (1) the excitation q at which the excitation signal is to be applied to fragment the ion of interest, (2) the excitation amplitude (V) to be used for that fragmentation, (3) the time for applying the fragmentation excitation signal, and (4) the mass(es) of the ion(s) of interest; Both in those embodiments employing high resolution isolation and those employing high resolution fragmentation excitation, the instructions can further include instructions to obtain values for the drive frequency, the drive RF amplitude, and the field radius. Similarly, in order to obtain the frequency to be used in an excitation signal to be applied at a given excitation q value, the instructions can include instructions to calculate the excitation signal frequency ($\omega$) from such values loaded into active memory. The drive amplitude can likewise be calculated from such recalled or inputted values, and instructions for that can also be provided.

In various embodiments hereof, an ion trap can employ traditional quadrupoles, or other configurations known in the art. In some embodiments, an ion trap for use herein can employ a quadrupole of hyperbolic rods, the use of which at very low pressures, such as those described herein, can permit an even more precise use of very low excitation amplitudes, such as those less than 2 or 1 mV. This would allow very low excitation amplitudes to be applied wherein an ion's trajectory would continue increasing until it were to collide with a rod. This is unlike the situation presented by use of traditional round rods wherein higher order fields serve to dampen the ion's trajectory and prevent it from colliding with a rod. Ions not of interest could be ejected to hyperbolic rods in this way. Then the ion of interest could be fragmented by increasing the pressure in the trap and applying the fragmentation excitation signal at an appropriate amplitude and duration. In various embodiments, such an ultra-high resolution ion isolation can be performed where the ion trap selected includes a quadrupole of hyperbolic rods. In other embodiments in which a quadrupole is selected for the ion trap geometry, the rods thereof can be of, e.g., a tear-drop or ovate cross-section; and the tapered side of each such rod can face toward the center of the quadrupole assemblage, i.e. toward the axis of the ion beam.

EXAMPLES

Experimental

Experiments are carried out on a triple quadrupole mass spectrometer research instrument having an ESI (electrospray ionization) source that produces charged particles of either polarity, the vacuum chamber with the Q0, Q1, Q2 and Q3 quadrupoles and a detector. The Q1 and Q3 quadrupoles are mass analyzing (RF/DC) quadrupoles while the Q0 and Q2 quadrupoles are rf-only quadrupoles. The Q3 quadrupole also doubles as the linear ion trap (LIT). Ions are trapped in the LIT by raising potentials on the ST3 lens, the Q3 quadrupole collar and the exit lens. The instrument includes a QJet at the front end (similar to the API 5000 product). The mass spectrometer is operated with a drive frequency of 1.228484 MHz. All of the excitations are carried out using dipole excitation. Sample solutions are a 1/100 dilution of the Agilent tuning mixture, 10 pg/μl of reserpine, 100 pg/μl of caffeine, mixtures of Chlorprothixene (2 ng/μl) with Fendiline (1 ng/μl), and of Chlorprothixene (2 ng/μl) with Oxycodone (0.5 ng/μl). Samples are infused at 7.0 μl/min. Data is collected using a scan speed of 1000 Da/s. Experiments are also carried out at 300 μl/min using flow injection for the peptide mixtures (data not shown).

Example 1

Identification and Initial Characterization of the Novel Technique

FIG. 1 shows the excitation profiles of the 195 m/z precursor of caffeine as a function of excitation q. The data is collected using the $MS^3$ trap scan mode and a drive frequency of 1.228 MHz. The intensity of the 195 m/z ($1^{st}$ precursor) is adjusted to give about 1 e6 cps intensity per scan. This is done to avoid complications from space charge. The m/z axis shows the value of the $2^{nd}$ precursor mass. When the $2^{nd}$ precursor mass brings the 195 m/z into resonance with the excitation signal the 195 m/z becomes excited. The excitation amplitudes are kept fairly low, which allows most of the target ion to undergo fragmentation as opposed to ejection form the LIT with the ion hitting an electrode. The pressure in the LIT region is kept at $3.6\times10^{-5}$ Torr and the ions are excited for a period of 100 ms. Excitation frequencies cover the range from 64.5 kHz at q=0.147 to 176.7 kHz at q=0.393.

One significant feature of FIG. 1 is the fact that at higher excitation q values, the resonance becomes narrower. At q=0.393 the resonance width is less than 0.2 m/z at the 0% depletion level while at q=0.205 the width is about 0.6 m/z at the 0% depletion level.

Experiments are then carried out to see how narrow the excitation profiles would be at q=0.706, the same q value that the rf/DC isolation occurs during the $MS^3$ isolation step. This is done for the caffeine ion (195 m/z) and the reserpine ion (609.23 m/z) and results are shown in FIGS. 2 and 3. These results show that it is possible to excite an ion at 195 m/z with a width of only 0.05 m/z while at 609.23 m/z the 0% depletion width is 0.09 m/z.

Based on such results, a new technique hereof can now be implemented to allow for high resolution isolation of an ion where high resolution is defined as isolating an ion population of less than 1.0 m/z in width. This can be carried out using the $MS^3$ scan. The following steps would be involved:

1. Fill the LIT with the ion of interest.
2. Turn on the resolving DC for a short period of time to isolate the ion of interest in a window of say 6 m/z width.
3. Eliminate ions that are within 0.1 m/z of the ion of interest using radial excitation
4. Re-apply the resolving DC for a short period of time to remove any fragmentation that may have occurred.
5. Change the excitation q to the desired excitation q that gives the appropriate mass range to collect the fragment ions
6. Excite the ion of interest and record the mass spectrum.

This method is demonstrated in FIG. 4 using a mixture of Chlorprothixene (316.0921 m/z) and Fendiline (316.206 m/z).

In the top frame of FIG. 4, no attempt is made to separate the two ions which are 0.1139 m/z apart. Excitation is applied at a nominal mass of 316.15 at q=0.4 using 22.5 mV excitation amplitude applied for 100 ms. A pulsed valve is used to increase the pressure during the excitation step to give increased MS3 efficiency at a shorter time. The pulsed valve is operated during the excitation at q=0.4 only. The major fragment at 212 m/z belongs to Fendiline while the fragments at 231, 271 and 273 m/z belong to Chlorprothixene.

The middle frame shows the same excitation conditions except that now Fendiline is ejected at step 3 of the above method using an excitation amplitude of 6 mV applied for 100 ms. The major fragment for Fendiline is now absent while the fragments for Chlorprothixene are still present. It should be noted that the intensity of the Chlorprothixene fragments are still at 100% of the intensity of their intensity in the top frame indicating that Chlorprothixene was not affected by the elimination of Fendiline.

The bottom frame shows the excitation of Fendiline after Chlorprothixene has been eliminated from the LIT, also using an excitation amplitude of 6 mV applied for 100 ms. As is the case in the middle frame, the ion not undergoing ejection is unaffected by the elimination process leaving only Fendiline which produced the fragment at 212 m/z.

The same experiment is then tried on the Oxycodone (316.1543 m/z) and Chlorprothixene (316.0921 m/z) which are 0.0622 m/z apart. The results are shown in FIG. 5.

The major fragment for Oxycodone occurs at 298 m/z, although another fragment at 256 m/z is seen when high energy fragmentation is performed, e.g., fragmentation using excitation amplitudes that provide 20, 30, or more eV of energy to the ions, such as 500 mV or more. Note that the vertical scale of the lower frame is a factor of 10 lower than the middle and upper frames. Elimination of the Chlorprothixene causes some loss of the Oxycodone which results in a reduction of the 298 m/z fragment to about 45% of its intensity compared to without eliminating the Chlorprothixene in the top frame. This result for a mass separation of 0.0622 m/z suggests that the lower limit of the proposed technique is approximately 0.05 m/z. Eliminating the Oxycodone from the mixture does not appear to cause any reduction in the intensity of the Chlorprothixene fragments as demonstrated in the middle frame.

Example 2

Exploring Methods for Clean-Up of Ions Neighboring an Ion of Interest

The data of FIGS. 4 and 5 are collected by simply eliminating one particular mass to demonstrate removal of potentially interfering ions. Such a step of cleaning-up the m/z-space around an ion of interest can be implemented by use of any of a variety of techniques, examples of which include:

1. Using a notched broadband waveform consisting of frequencies spaced to give mass steps of 0.1 m/z. The component amplitudes would have to be kept low, on the order of 6 mV for the compounds tested, with more testing required to see if a generic amplitude could be used. The number of waveform components would have to simply cover the mass range not covered by the application of the rf/dc.
2. The more time-consuming approach of sequential elimination of the unwanted ions by shifting either the rf amplitude or the excitation frequency: in practice, if this technique were selected, it would typically be implemented by shifting the rf amplitude, given the current electronics, due to the discreet nature of the excitation waveform frequencies).

The goal of the isolation step is to remove any potential interferences without any loss of the ion of interest. This implies that application of the resolving DC should be directed to an isolation window width of a few m/z, so that intensity is not substantially decreased. This means that if a notched broadband waveform is used then the number of components required would cover a range of, e.g., 4 m/z. This would be about 40 components each with an amplitude of around 10 mV or less.

In some embodiments, it is also possible to simply eliminate ions near the mass of interest that would be excited by the excitation signal that is applied to the mass of interest. If ions in the subpopulation are not affected by the excitation signal and do not lie in a region of interest for a fragment mass, then they do not need to be removed. This would be the case for many or most ions. For example, if the rf/dc isolates a subpopulation of 4 m/z width, then it is unlikely that a fragment produced would show up within that particular mass range. It may in the case of multiply charged ions, but it is usually not the case.

Example 3

Effect of Excitation Amplitude

The effects of excitation amplitude can be seen in FIG. 6. Resonance excitation profiles for 322 m/z are measured using excitation amplitudes of 6, 10 and 20 mV. The duration of the excitation is 100 ms in each case. A significant feature of this graph is the fact that the profile width increases with excitation amplitude. This means that in order for high excitation or isolation to work most efficiently, the excitation amplitude is preferably kept as low as reasonably possible.

This low value for excitation amplitude is explained with reference to the following exemplary embodiments. In the first case, if we assume that the highest possible resolution is desired, then one would choose a long excitation period (100 ms or greater) and proceed by decreasing the excitation amplitude until no depletion of the ion is observed. This would be the threshold for fragmentation. It is possible to fragment ions with as little as 2 mV amplitude (to the 50% level) using an excitation period of 100 ms (data not shown). Increasing the excitation period to even longer times would increase the amount of fragmentation. Duty cycle then becomes an issue. If the ions to be separated are spaced by 0.2 m/z then a higher amplitude can be used and the excitation period can be shortened.

It should also be noted that the ability to excite with such low amplitudes is something that cannot be accomplished on a 3-D trap or on a commercially available linear ion trap (the LTQ linear ion trap available from Thermo Fisher). Both of these devices operate at pressures of at least 1 mTorr of He. In this pressure range the damping from the gas would be too high to allow the ion to attain enough internal energy for fragmentation. It has already been recognized that the width of the frequency response profile of an ion is dependent upon the excitation amplitude used and not the pressure of the background gas that is used to transfer kinetic energy into internal energy of the ion (See Collings et al., RCM 15:1777-1795 (2001), FIG. 3). The pressure of the background gas simply limits the minimum amplitude required for excitation to take place.

In contrast, a device such as the MDS Sciex (MDS Analytical Technologies) hybrid triple quadrupole/linear ion trap (Q Trap) mass spectrometer, which operates at about 4 or $5\times10^{-5}$ Torr or less, or other low-pressure mass spectrometry devices, can be used to implement various embodiments of methods described herein. As shown in FIG. 6, where $P_{h\nu}=1.4\times10^{-5}$ Torr, the resolution is set by how low the excitation amplitude can be reduced while still causing the desired fragmentation or depletion of the precursor ion. One of the advantages of the Q Trap systems is that the LIT normally operates at pressures on the order of 4 to $5\times10^{-5}$ Torr where damping from the background gas is minimal. This allows the use of low excitation amplitudes.

Example 4

Characterization of Potential Effects of Drive Frequency, q and Mass on Isolation Resolution In order to characterize how the mass resolution is influenced by drive frequency, q value and mass, an ion trajectory simulator, Sx, was used to address the effects of these parameters. The Sx simulator is described in F. A. Londry and J. W. Hager, *Mass selective axial ion ejection from a linear quadrupole ion trap*, J. Am. Soc. Mass Spectrom. 2003, 14, 1130-1147.

FIG. 7 shows the results of simulations in which an ion, 322 m/z, is excited using 20 mV of excitation amplitude for a period of 10 ms at $P_{h\nu}$=5.0e-5 Torr. The energy loss for each collision during the excitation period is recorded and added together to obtain a total energy loss. The total energy loss is about 2 times the centre of mass kinetic energy. The centre of mass kinetic energy is the amount of energy available for conversion to internal energy of the ion. The collision cross section of 175 $Å^2$ is an estimate based upon the measured collision cross sections for leucine (131 m/z, 105 $Å^2$) and reserpine (609 m/z, 280 $Å^2$); see, Javahery and Thomson, JASMS, 8, 697-702 (1997). The data of FIG. 6 is collected using drive frequencies of 816 kHz (4000 Q trap) and for a hybrid triple quadrupole linear ion trap mass spectrometer operating at 1.228 MHz. The ions secular frequency is 232, 940 Hz for the 816 kHz drive frequency and 350,665 Hz when the drive frequency is 1.228 MHz. The width of the frequency response profile is the same in each case about 200 Hz at FWHM. This width is greater than that seen in the experimental data of FIGS. 2 and 3 which is collected using a lower excitation amplitude and a longer excitation period. The simulation is run using a higher excitation amplitude and a higher background pressure (compared to the pressure used in the experiments of FIG. 6) in order to give reasonable signal to noise. The excitation period used is only 10 ms to allow the simulations to be carried out in a shorter time period.

FIG. 8 shows the frequency response profile when exciting the ion at two different q values, 0.235 and 0.706, while maintaining the drive frequency at 1.228 MHz. Once again, the width of the resonance is about 200 Hz with maybe some slight broadening at the lower q value. The results show that the width of the frequency response profile is relatively independent of the drive frequency and the excitation q.

An additional set of simulations are run to determine the effects that mass of the ion and collision cross section may have on the width of the frequency response profile. The results are shown in FIG. 9. The profile widths are slightly narrower for the 609 and 2722 m/z profiles when compared to the 322 m/z profile. There is not a significant difference between the 609 and 2722 m/z profiles. The simulations are run using collision cross sections of 175, 280 and 500 $Å^2$ for 322, 609 and 2722 m/z respectively. Once again, all other conditions are kept constant.

Based on a first order estimation that the same excitation amplitude can be used across the mass range, it is generally possible to predict what the resonance peak widths would be at different drive frequencies, q values, and masses, for many ions of interest. A slight modification of the excitation period can be important for particularly tough-to-fragment ions. Thus, the difference for them would be in the excitation period if the excitation amplitude is held constant. A tough-to-fragment ion would require more time to convert enough kinetic energy, from collisions, to internal energy to cause fragmentation. In other words, the excitation time can differ, depending on the internal energy required to cause fragmentation when using a constant excitation amplitude. FIG. 10 shows plots of the frequency density (Hz/Da) for the drive frequencies 816 kHz and 1.228484 MHz as a function of q and m/z. The frequency density increases with increasing drive frequency and q, and increases with decreasing m/z.

The data of FIG. 10 can be used to calculate the expected resonance width in m/z units. This is applied for a profile width of 100 Hz (FIG. 2 shows a profile width of 122 Hz while FIG. 3 has a width of 69 Hz) and the results are shown in FIG. 11. These plots allow one to estimate what sort of mass separation can be expected for a particular ion at a particular drive frequency and q value using an excitation amplitude that results in a frequency response profile width of about 100 Hz.

Example 5

Direct Fragmentation

In another application of a high resolution selection technique hereof, preliminary experiments show that, at q values of at least 0.4 or 0.5, the ions are actually fragmented and not ejected to the rods, due to the use of the low excitation amplitude. Thus, it is possible to simply fragment an ion which has fragment masses that allow the use of a high q value, wherein then the expected resonance width can be determined from the plots presented in of FIG. 11. This can allow the user to determine if the mass separation would be sufficient for excitation of one component in a mixture. For example, if reserpine is excited at q=0.5 on a 1.228 MHz instrument, then the low mass cut-off would be 335.8 m/z and the resonance width would be 0.24 m/z. This would allow the 397 and 448 m/z fragments to be monitored while allowing components 0.24 m/z to be excited separately without the use of an isolation technique.

What is claimed is:

1. A method for mass spectrometry comprising:

providing an excitation q value that is greater than zero and less than 0.908, and maintaining an ion trap of a mass spectrometer under vacuum pressure of 1 mTorr or less while:

(a) introducing an ion population into the trap, the ion population comprising an ion of interest;

(b) applying a resolving direct current to the ion trap for a time sufficient to isolate from the trapped ion population an ion subpopulation within a window of about 10 m/z or less, the ion subpopulation comprising the ion of interest;

(c) when the m/z of the ion of interest is above or equal to the low mass cut-off determined by the excitation q:

applying an excitation signal to the ion subpopulation to remove any ions, other than the ion of interest, from the subpopulation that have a mass/charge ratio (m/z) that is within 2 m/z or less of the ion of interest, at an excitation amplitude (V) that is from about 1 mV to 100 mV for a time sufficient to eject ions from a mass window having a width of 2 m/z or less and being centered on the ion of interest, said excitation amplitude (V) being about 0.05 to about 10 mV above a minimum that is the threshold amplitude for the onset of ejection of said ions, while retaining the ion of interest in a remaining ion subpopulation in the ion trap.

2. The method according to claim 1, wherein the resolving direct current of step (b) is applied for a time of at least or about 10 microseconds.

3. The method according to claim 1, wherein the resolving direct current is applied for a time of about at least or about 100 microseconds.

4. The method according to claim 1, wherein the resolving direct current is applied for a time of about 1 ms.

5. The method according to claim 1, wherein the excitation signal of step (c) is applied for a time of at least or about 10 ms.

6. The method according to claim 5, wherein the excitation signal is applied for a time of about 50 ms.

7. The method according to claim 1, wherein the ion trap is operated at a drive frequency that is from about 500 kHz to about 10 MHz.

8. The method according to claim 7, wherein the drive frequency is from about 2 MHz to about 5 MHz.

9. The method according to claim 1, wherein the excitation amplitude (V) of step (c) of the method is at least 5 mV and less than 100 mV.

10. The method according to claim 9, wherein the excitation amplitude (V) is about 10 mV or less.

11. The method according to claim 1, wherein the vacuum pressure is about $5*10^{-5}$ Torr or less.

12. The method according to claim 1, wherein the window of step (b) is about 5 m/z or less.

13. The method according to claim 1, further comprising scanning ions out from the ion trap and detecting the ion of interest, after performing step (c).

14. The method according to claim 1, wherein step (c) comprises:

applying a notched waveform that is capable of ejecting ions of the subpopulation that have a mass/charge ratio (m/z) that is within 2 m/z of the ion of interest, the notched waveform being comprised of waveform components that each independently have an amplitude of about or less than 10 mV, and being applied for a sufficient time to eject ions other than the ion of interest.

15. The method according to claim 14, wherein each of said waveform components independently has an amplitude of about 1 mV or more.

16. The method according to claim 14, wherein the notched waveform is applied for a time of at least or about 10 ms.

17. The method according to claim 1, wherein step (c) comprises:

applying a series of notched waveforms, each of which is capable of ejecting an ion or ions of the subpopulation that have a mass/charge ratio (m/z) that is within 2 m/z of the ion of interest, while leaving the ion of interest, each of the notched waveforms being comprised of waveform components that each independently have an amplitude of about or less than 10 mV and being applied for a sufficient time to eject of an ion or ions other than the ion of interest.

18. The method according to claim 17, wherein each of said waveform components independently has an amplitude of about 1 mV or more.

19. The method according to claim 17, wherein each of the notched waveforms is applied for a time of at least or about 10 ms.

20. The method according to claim 1, wherein the ion subpopulation of step (b) comprises two or more ions of interest, including first and second ions of interest, the step (c) of applying an excitation signal comprises applying radial excitation to the ion trap to remove ions from the subpopulation that have a mass/charge ratio (m/z) that is within 2 m/z of each of the ions of interest, while retaining in the ion trap a remaining ion subpopulation that comprises the ions of interest.

21. The method according to claim 1, wherein the excitation signal of step (c) removes ions that have a m/z ratio that is within about 1 m/z of the ion of interest, thereby providing an isolation having a resolution of about or less than 1 m/z.

22. The method according to claim 1, wherein the excitation signal of step (c) removes ions that have a m/z ratio that is within about 0.1 m/z of the ion of interest, thereby providing an isolation having a resolution of about or less than 0.1 m/z.

23. The method according to claim 1, wherein step (c) comprises:

applying conditions capable of ejecting said ions having a mass/charge ratio (m/z) that is within 2 m/z of the ion of interest.

24. The method according to claim 1, wherein the ion trap is a linear ion trap of a triple quadrupole mass spectrometer.

25. A mass spectrometry apparatus comprising:

an ion trap under a vacuum pressure of about 1 mTorr or less, the ion trap being operable to contain an ion population for a period of time sufficient to isolate therefrom a subpopulation of ions that includes an ion of interest and that is within a window of about 10 m/z or less; and a programmable controller operably coupled to the ion trap, the programmable controller being programmed with an algorithm comprising instructions for the controller:

(a) to apply a resolving direct current to the ion trap for a period of time sufficient to isolate said subpopulation of ions within said window;

(b) when the m/z of the ion of interest is equal to or above the low mass cut-off determined by a retrieved-from-storage, user-inputted, or calculated-from-user-input excitation q value, said excitation q value being greater than zero and less than 0.908:

to apply an excitation signal to the ion subpopulation to remove any ions, other than the ion of interest, from the subpopulation that have a mass/charge ratio (m/z) that is within 2 m/z or less of the ion of interest, at an excitation amplitude (V) that is from about 1 mV to 100 mV for a time sufficient to eject ions that arise from a mass window having a width of 2 m/z or less and being centered on the ion of interest, said excitation amplitude (V) being about 0.05 to about 10 mV above a minimum that is the threshold amplitude for the onset of ejection of said ions, while retaining the ion of interest in a remaining ion subpopulation in the ion trap.

26. The apparatus according to claim 25, wherein the period of time of step (a) is at least or about 10 microseconds.

27. The apparatus according to claim 25, wherein said period of time is at least or about 100 microseconds.

28. The apparatus according to claim 25, wherein said period of time is about 1 ms.

29. The apparatus according to claim 25, wherein the excitation signal of step (b) is applied for a time of at least or about 10 ms.

30. The apparatus according to claim 29, wherein said time is about 50 ms.

31. The apparatus according to claim 25, wherein the ion trap is operated at a drive frequency that is from about 500 kHz to about 10 MHz.

32. The apparatus according to claim 31, wherein the drive frequency is from about 2 MHz to about 5 MHz.

33. The apparatus according to claim 25, wherein the excitation amplitude (V) of step (b) or (c) is at least 5 mV and less than 100 mV.

34. The apparatus according to claim 33, wherein the excitation amplitude (V) is about 10 mV or less.

35. The apparatus according to claim 25, wherein step (b) comprises:

applying a notched waveform that is capable of ejecting ions of the subpopulation that have a mass/charge ratio (m/z) that is within 2 m/z of the ion of interest, while leaving the ion of interest, the notched waveform being comprised of waveform components that each independently have an amplitude of about or less than 10 mV and being applied for a sufficient time to eject ions other than the ion of interest.

36. The apparatus according to claim 35, wherein each of said waveform components has an amplitude of about 1 mV or more.

37. The apparatus according to claim 35, wherein the notched waveform is applied for a time of at least or about 10 ms.

38. The apparatus according to claim 25, wherein step (b) comprises:

applying a series of notched waveforms, each of which is capable of ejecting an ion or ions of the subpopulation that have a mass/charge ratio (m/z) that is within 2 m/z of the ion of interest, while leaving the ion of interest, each of the notched waveforms being comprised of waveform components that each independently have an amplitude of about or less than 10 mV and being applied for a sufficient time to eject ions other than the ion of interest.

39. The apparatus according to claim 38, wherein each of said waveform components has an amplitude of about 1 mV or more.

40. The apparatus according to claim 38, wherein each of the notched waveforms is applied for a time of at least or about 10 ms.

41. The apparatus according to claim 25, wherein the ion subpopulation of step (a) comprises two or more ions of interest, including first and second ions of interest, the step (b) of applying an excitation signal comprises applying radial excitation to the ion trap to remove ions from the subpopulation that have a mass/charge ratio (m/z) that is within 2 m/z of each of the ions of interest, while retaining in the ion trap a remaining ion subpopulation that comprises the ions of interest.

42. The apparatus according to claim 25, wherein the excitation signal of step (b) removes ions that have a m/z ratio that is within about 1 m/z of the ion of interest, thereby providing an isolation having a resolution of about or less than 1 m/z.

43. The apparatus according to claim 42, wherein the excitation signal of step (b) removes ions that have a m/z ratio that is within about 0.1 m/z of the ion of interest, thereby providing an isolation having a resolution of about or less than 0.1 m/z.

44. The apparatus according to claim 25, wherein step (c) comprises:

applying conditions capable of ejecting said ions having a mass/charge ratio (m/z) that is within 2 m/z of the ion of interest.

45. The apparatus according to claim 25, wherein the vacuum pressure is about $5*10^{-5}$ Torr or less.

46. The apparatus according to claim 25, wherein the window of step (a) is about 5 m/z or less.

47. The apparatus according to claim 25, wherein the ion trap is a linear ion trap of a triple quadrupole mass spectrometer.

48. The apparatus according to claim 25, wherein the algorithm further comprises instructions for the controller to obtain, and to load into active memory, values, for use in step (a) and step (b), for:

(1) the resolving direct current of step (a);

(2) the application time for the resolving direct current of step (a);

(3) the excitation amplitudes (V) of step (b);

(4) the time for applying the excitation signals of step (b); and (5) the mass(es) of the ion(s) of interest;

(6) all three of (i) the drive frequency, (ii) the drive RF amplitude, and (iii) the field radius, with (6) being obtained where said algorithm further comprises instructions to calculate from the values thereof the excitation q value of step (b).

49. The apparatus according to claim 48, wherein each of the instructions to obtain the values comprises an instruction to retrieve the values from stored memory or to request and receive the values as input from a user, or any combination thereof.

* * * * *